US007507463B2

(12) United States Patent
Noda et al.

(10) Patent No.: US 7,507,463 B2
(45) Date of Patent: Mar. 24, 2009

(54) NONWOVEN FABRIC

(75) Inventors: Yuki Noda, Kagawa (JP); Hideyuki Ishikawa, Kagawa (JP); Satoshi Mizutani, Kagawa (JP); Akihiro Kimura, Kagawa (JP)

(73) Assignee: Uni-Charm Corporation, Shikokuchuo-Shi (JP)

( * ) Notice: Subject to any disclaimer, the term of this patent is extended or adjusted under 35 U.S.C. 154(b) by 0 days.

(21) Appl. No.: 11/757,218

(22) Filed: Jun. 1, 2007

(65) Prior Publication Data

US 2008/0044622 A1 Feb. 21, 2008

(30) Foreign Application Priority Data

Jun. 23, 2006 (JP) ..... 2006-174505
Sep. 29, 2006 (JP) ..... 2006-270109

(51) Int. Cl.

| | |
|---|---|
| ***B32B 3/00*** | (2006.01) |
| ***B32B 3/28*** | (2006.01) |
| ***B32B 3/30*** | (2006.01) |
| ***B32B 5/14*** | (2006.01) |
| ***B32B 7/02*** | (2006.01) |
| ***B32B 3/10*** | (2006.01) |

(52) U.S. Cl. ..... 428/167; 428/156; 428/170; 428/171; 428/172; 428/131; 428/138; 428/218; 428/137; 442/327

(58) Field of Classification Search ..... 428/156, 428/167, 170, 171, 172, 131, 137, 138, 218; 604/385.01, 378–380, 384; 442/327
See application file for complete search history.

(56) References Cited

U.S. PATENT DOCUMENTS

| | | | | |
|---|---|---|---|---|
| 4,016,319 | A | 4/1977 | Marshall | |
| 5,618,610 | A | 4/1997 | Tomita et al. | |
| 6,096,016 | A | 8/2000 | Tsuji et al. | |
| 6,451,718 | B1 * | 9/2002 | Yamada et al. | 442/149 |
| 6,641,902 | B1 * | 11/2003 | Kobayashi et al. | 428/220 |
| 6,867,156 | B1 * | 3/2005 | White et al. | 442/334 |

(Continued)

FOREIGN PATENT DOCUMENTS

JP 02-167818 A 6/1990

(Continued)

OTHER PUBLICATIONS

International Search Report of PCT/JP2007/061444 issued Aug. 7, 2007.

(Continued)

*Primary Examiner*—Jennifer McNeil
*Assistant Examiner*—Catherine Simone
(74) *Attorney, Agent, or Firm*—Lowe Hauptman Ham & Berner, LLP

(57) ABSTRACT

A nonwoven fabric adjusted so that the fiber densities of convex portions and recessed portions are not excessively high. A plurality of open portions is formed by blowing fluid mainly composed of gas from the top side of a fiber web onto the fiber web supported from the bottom side thereof by a supporting member, and moving fiber constituting the fiber web. The nonwoven fabric is formed with the plurality of open portions continuously formed at predetermined intervals along a predetermined direction and a plurality of joining portions formed between the open portions adjacent thereto in a predetermined direction.

23 Claims, 22 Drawing Sheets

U.S. PATENT DOCUMENTS 6,936,333 B2 * 8/2005 Shizuno et al. ..... 428/156

FOREIGN PATENT DOCUMENTS

| | | | |
|---|---|---|---|
| JP | 02-229255 | A | 9/1990 |
| JP | 08-600509 | A | 3/1996 |
| JP | 08-216310 | A | 8/1996 |
| JP | 11-342154 | A | 12/1999 |
| JP | 2002-030557 | A | 1/2002 |
| JP | 2002-136547 | A | 5/2002 |
| JP | 2002-249965 | A | 9/2002 |
| JP | 2003-024372 | A | 1/2003 |
| JP | 3587831 | B2 | 8/2004 |

OTHER PUBLICATIONS

International Search Report of PCT/JP2007/061445 issued Jul. 31, 2007.

International Search Report of PCT/JP2007/061601 issued Aug. 7, 2007.

International Search Report of PCT/JP2007/060543 issued Jul. 10, 2007.

* cited by examiner

NONWOVEN FABRIC

This application is based on and claims the benefit of priority from Japanese Patent Application No. 2006-174505, filed on Jun. 23, 2006 and Japanese Patent Application No. 2006-270109, filed on Sep. 29, 2006, the content of which is incorporated herein by reference.

BACKGROUND OF THE INVENTION

1. Field of the Invention

The present invention relates to nonwoven fabrics.

2. Related Art

Conventionally, nonwoven fabrics are used in a wide variety of fields, for example, hygiene products such as paper diapers and sanitary napkins, cleaning products such as wipers, and medical products such as masks. In this way, the nonwoven fabrics have been used in various fields. For practical use in products in each field, however, the nonwoven fabrics are required to be produced so as to have characteristics and structures suited to the application of each of the products.

The nonwoven fabrics are formed, for example, by forming fiber layers (fiber webs) by means of a dry method, a wet method or the like, then bonding the fibers that constitute the fiber layers to each other by means of a chemical bond method, a thermal bond method or the like. Such a process of bonding the fibers that constitute the fiber layers, includes a method in which a plurality of needles are repeatedly inserted into the fiber layers and a method in which physical force, such as a water jet stream, is externally applied to the fiber layers.

However, these methods simply help to entangle the fibers with each other and do not adjust the orientation or the arrangement of fibers in the fiber layers or shapes of the fiber layers. In other words, what is produced by means of these methods is merely a sheet-like nonwoven fabric.

A nonwoven fabric with openings is also proposed. To provide openings for a nonwoven fabric, a method is proposed in which a spatial opening is provided by inserting the nonwoven fabric between a mold, having projections such as outwardly projecting needles, and a supporter, which receives the projections and then penetrating the projection portion into the nonwoven fabric (e.g. see Japanese Patent Laid-Open Publication No. H6-330443.)

However, such a nonwoven fabric, if a fiber assembly constituting the nonwoven fabric is included between a projection portion and a receiving-side supporter, will have undulations or openings therein. Therefore, fibers at a wall surface of a projection portion and an opening peripheral edge are compressed, so that a fiber density becomes higher and further is sometimes filmed during generation of nonwoven fabric by heating.

Therefore, when such a nonwoven fabric is used in a surface sheet of an absorbable product or the like, the projection portion, which has a high fiber density, and the opening peripheral edge or the filmed opening peripheral edge may become resistant to liquid absorption. As a result, if a large amount of liquid is transferred to the projection portion or the opening peripheral edge, the liquid gathers on the nonwoven fabric, and hence may soil the skin of a user and make him/her uncomfortable.

SUMMARY OF THE INVENTION

It is an objective of the present invention to provide a nonwoven fabric having undulations and open portions which are tailored so that liquid is able to pass through projection portions and recessed portions.

The inventors have found that open portions and undulations can be formed by blowing a gas from the top side onto a fiber web supported from the bottom side by a permeable support member having a predetermined impermeable portion so that the fiber constituting the fiber web moves, and completed the present invention.

According to a first aspect of the present invention, a nonwoven fabric having a first direction and a second direction, including: a plurality of open portions formed along the first direction; and a plurality of joining portions formed between the predetermined open portions in the plurality of open portions and open portions adjacent to the predetermined open portions along the first direction, wherein each of the plurality of joining portions having a greater percent content of fiber oriented in the second direction compared to that oriented in the first direction.

In a second aspect of the nonwoven fabric as described in the first aspect of the present invention, a fiber in the peripheral edge of each of the plurality of open portions is oriented along the peripheral edge of each of the plurality of open portions.

In a third aspect of the nonwoven fabric as described in the first or second aspects of the present invention, each of the plurality of open portions is substantially circular or substantially oval.

In a forth aspect of the nonwoven fabric as described in any one of the first to third aspects of the present invention, each of the plurality of open portions is 0.1 to 5 mm in length in the first direction.

In a fifth aspect of the nonwoven fabric as described in any one of the first to fourth aspects of the present invention, further including: a plurality of groove portions recessed in the thickness direction on a first surface side of the nonwoven fabric, formed by the plurality of open portions and the plurality of joining portions; and a plurality of convex portions projecting in the thickness direction on the first surface side, the plurality of convex portions being adjacent to and along the plurality of the groove portions.

In a sixth aspect of the nonwoven fabric as described in the fifth aspect of the present invention, each of the plurality of groove portions is constituted so that a height in the thickness direction of the nonwoven fabric is not greater than 90% of the height of each of the plurality of convex portions.

In a seventh aspect of the nonwoven fabric as described in the fifth or sixth aspects of the present invention, predetermined convex portions in the plurality of convex portions are different in height from convex portions adjacent to the convex portions across the plurality of groove portions sandwiched therebetween.

In an eighth aspect of the nonwoven fabric as described in any one of the fifth to seventh aspects of the present invention, each of the plurality of joining portions is further recessed in the thickness direction of the nonwoven fabric in each of the plurality of groove portions.

In a ninth aspect of the nonwoven fabric as described in any one of the fifth to eighth aspects of the present invention, the top of each of the plurality of convex portions is substantially flat.

In a tenth aspect of the nonwoven fabric as described in any one of the fifth to ninth aspects of the present invention, a second surface, which is a surface on the opposite side to a surface formed with the plurality of groove portions and the plurality of convex portions in the nonwoven fabric, is formed with a plurality of areas projecting to the opposite side to the projecting direction of the convex portions.

In an eleventh aspect of the nonwoven fabric as described in any one of the fifth to tenth aspects of the present invention, further undulating in the first direction.

In a twelfth aspect of the nonwoven fabric as described in any one of the fifth to ninth aspects of the present invention, the second surface of the nonwoven fabric is substantially flat.

In a thirteenth aspect of the nonwoven fabric as described in any one of the fifth to twelfth aspects of the present invention, each of a plurality of side portions in each of the plurality of convex portions is constituted so that the percent content of fiber oriented in the first direction is greater than that oriented in the second direction.

In a fourteenth aspect of the nonwoven fabric as described in any one of the fifth to thirteenth aspects of the present invention, each of the plurality of convex portions is constituted so that a percent open area measured from the first surface side of the predetermined convex portions is greater than that measured from the second surface side of the predetermined convex portions.

In a fifteenth aspect of the nonwoven fabric as described in any one of the fifth to fourteenth aspects of the present invention, each of the plurality of convex portions further includes a plurality of central portions in areas sandwiched between the plurality of side portions, and each of the plurality of central portions is constituted so that the fiber density of each of the plurality of central portions is greater than that of each of the plurality of joining portions and is lower than that of each of the plurality of side portions.

In a sixteenth aspect of the nonwoven fabric as described in any one of the fifth to fifteenth aspects of the present invention, the fiber density of each of the plurality of convex portions is no greater than 0.20 g/cm$^3$, while the fiber density of each of the plurality of joining portions is no greater than 0.20 g/cm$^3$.

In a seventeenth aspect of the nonwoven fabric as described in any one of the fifth to sixteenth aspects of the present invention, each of the plurality of joining portions is constituted so that a basis weight of each of the plurality of joining portions is less than that of each of the plurality of convex portions.

In an eighteenth aspects of the nonwoven fabric as described in any one of the fifth to seventeenth embodiments of the present invention, each of the plurality of convex portions is constituted so that the basis weight is from 15 to 250 g/m$^2$, while each of the plurality of joining portions is constituted so that the basis weight is from 5 to 200 g/m$^2$.

In a nineteenth aspect of the nonwoven fabric as described in any one of the first to eighteenth aspects of the present invention, fiber constituting the nonwoven fabric includes water-repellent fiber.

It is an objective of the present invention to provide a nonwoven fabric having undulations and open portions which are tailored so that liquid is able to pass through convex portions and recessed portions.

DETAILED DESCRIPTION OF THE INVENTION

Preferred embodiments of the present invention will now be explained with reference to the drawings.

Figure 1A:
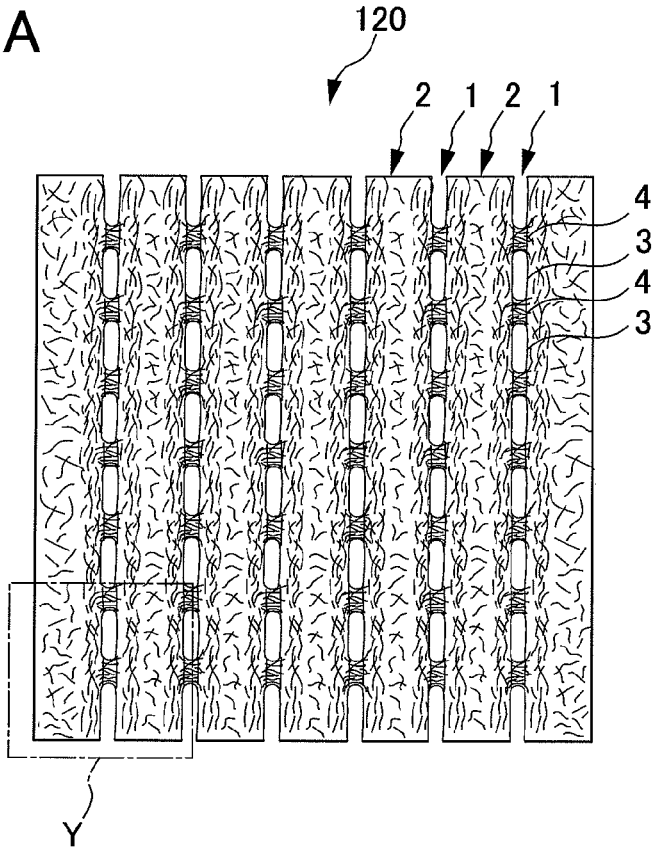
FIG. 1A shows a plan view of a nonwoven fabric according to a first embodiment of the present invention.
Figure 1B:
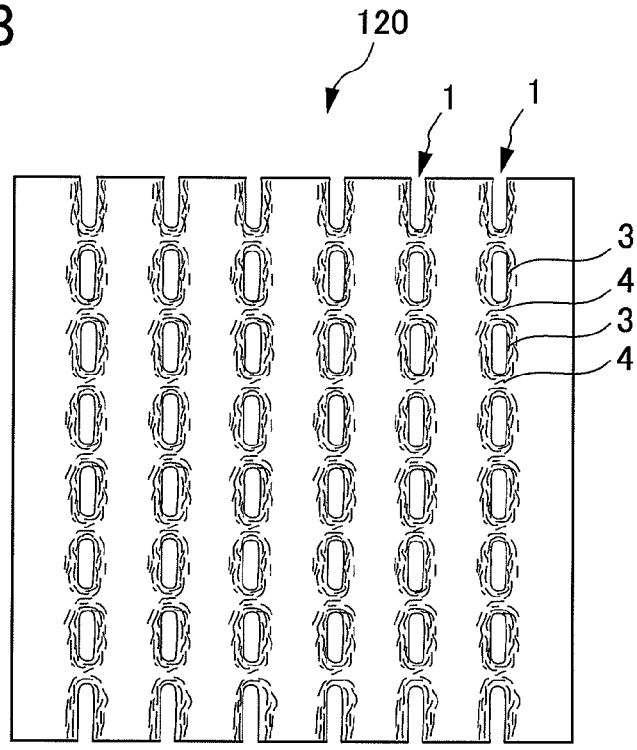
FIG. 1B shows a bottom view of a nonwoven fabric according to a first embodiment of the present invention.
Figure 2:
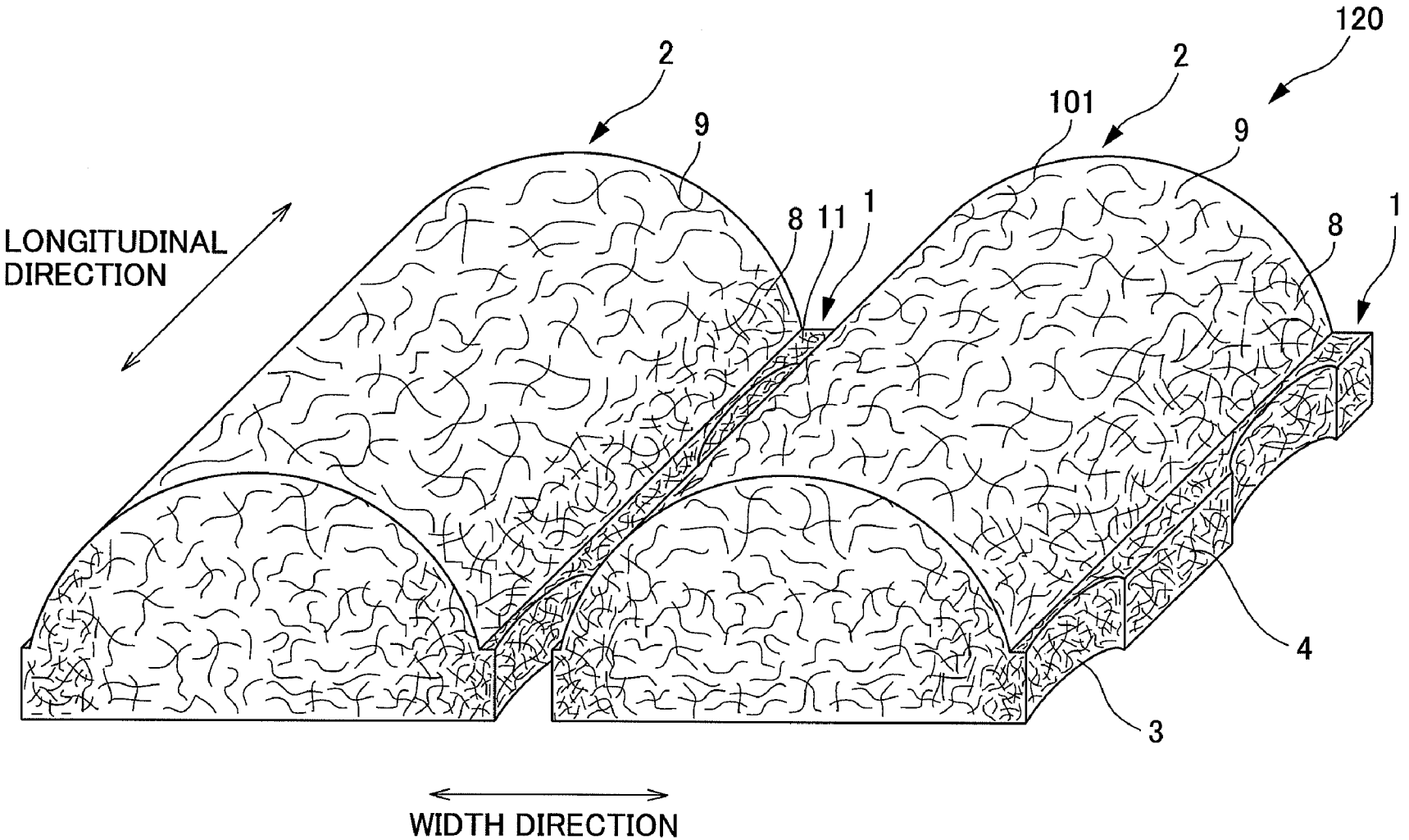
FIG. 2 shows an enlarged perspective view of an area Y as defined in FIG. 1.
Figure 3A:
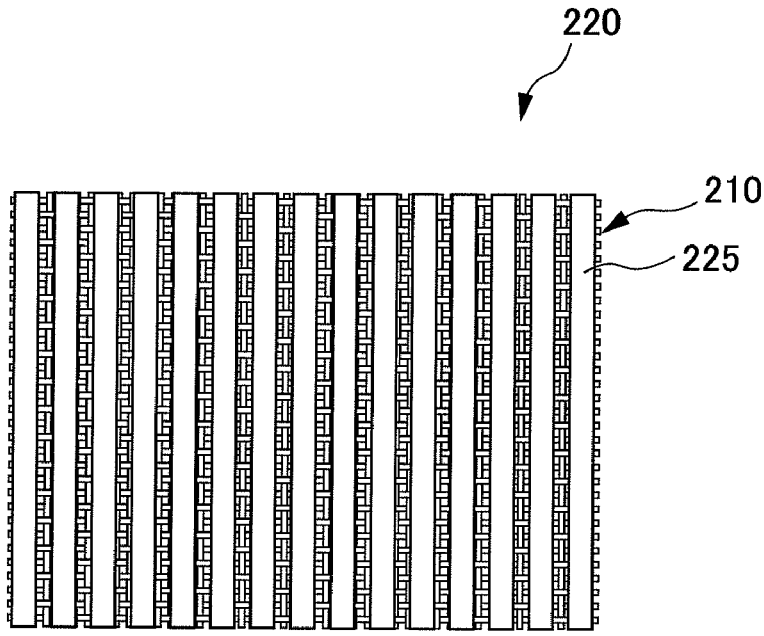
FIG. 3A shows a plan view of a supporting member formed by arranging slender members on a mesh support member in parallel at even intervals.
Figure 3B:
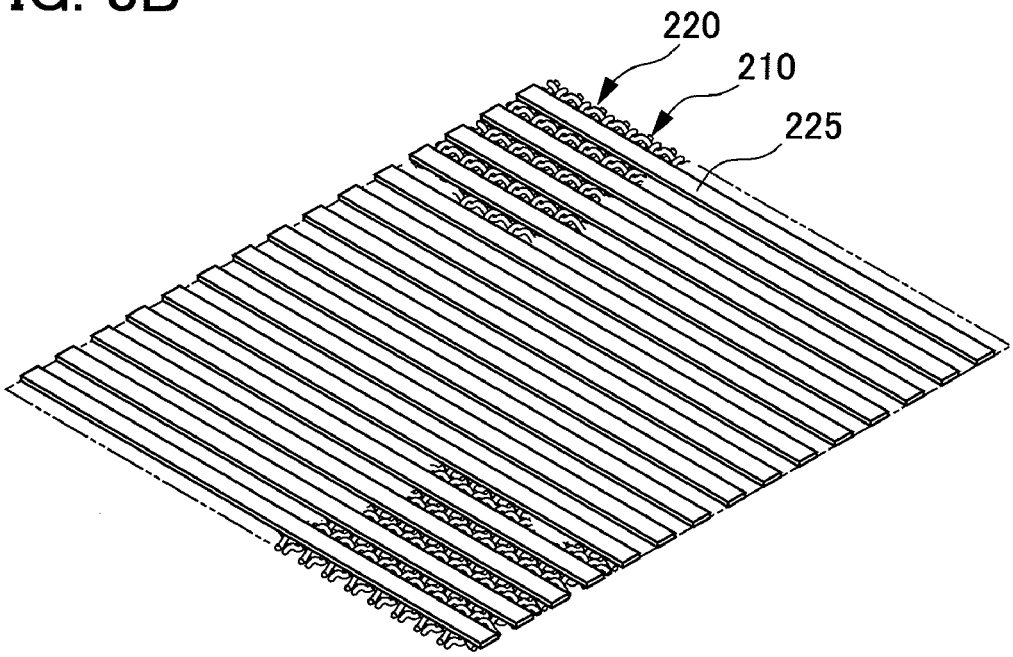
FIG. 3B shows a perspective view of a supporting member formed by arranging slender members on a mesh support member in parallel at even intervals.
Figure 4A:
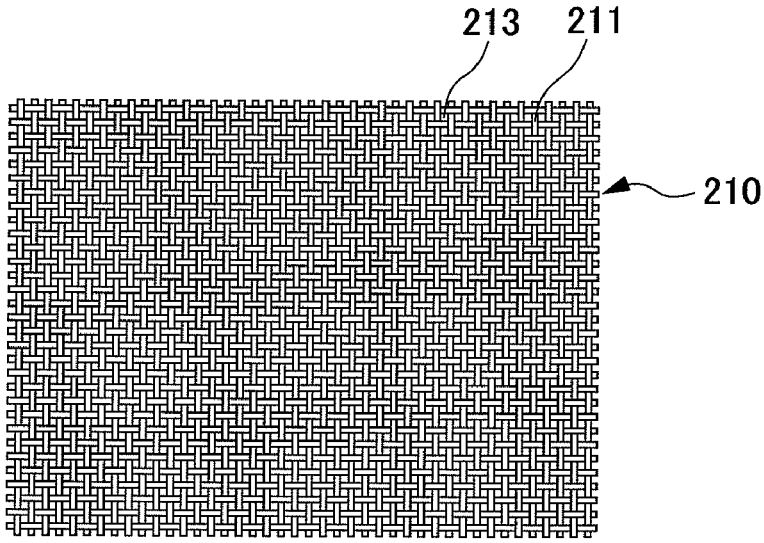
FIG. 4A shows a plan view of the mesh support member described in FIG. 3.
Figure 4B:
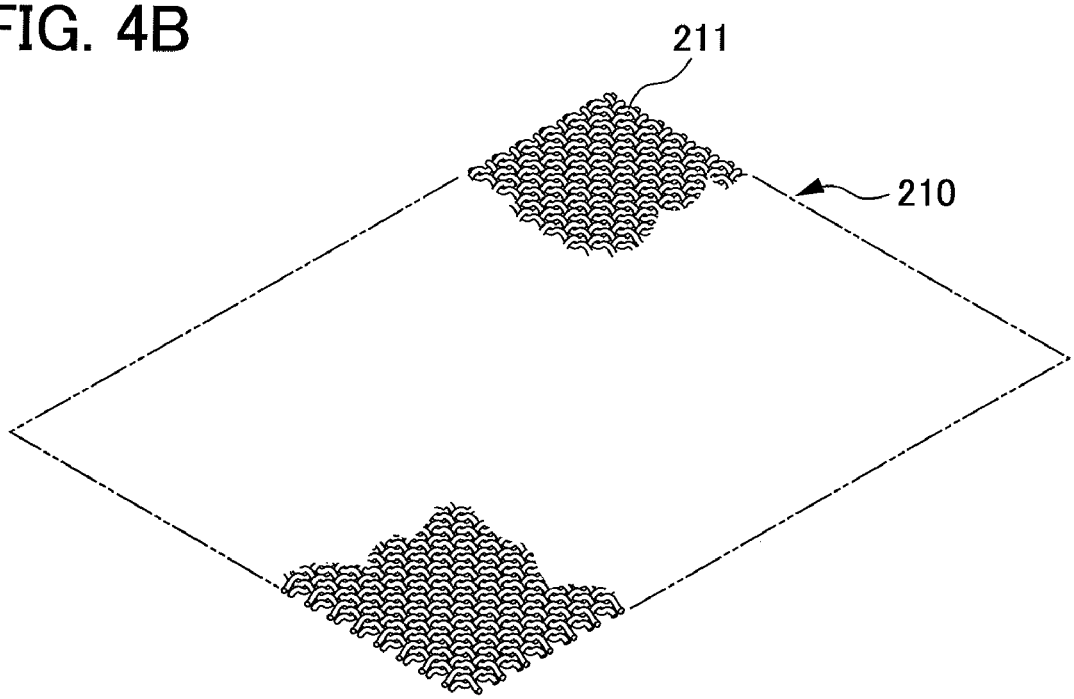
FIG. 4B shows a perspective view of the mesh support member described in FIG. 3.
Figure 5:
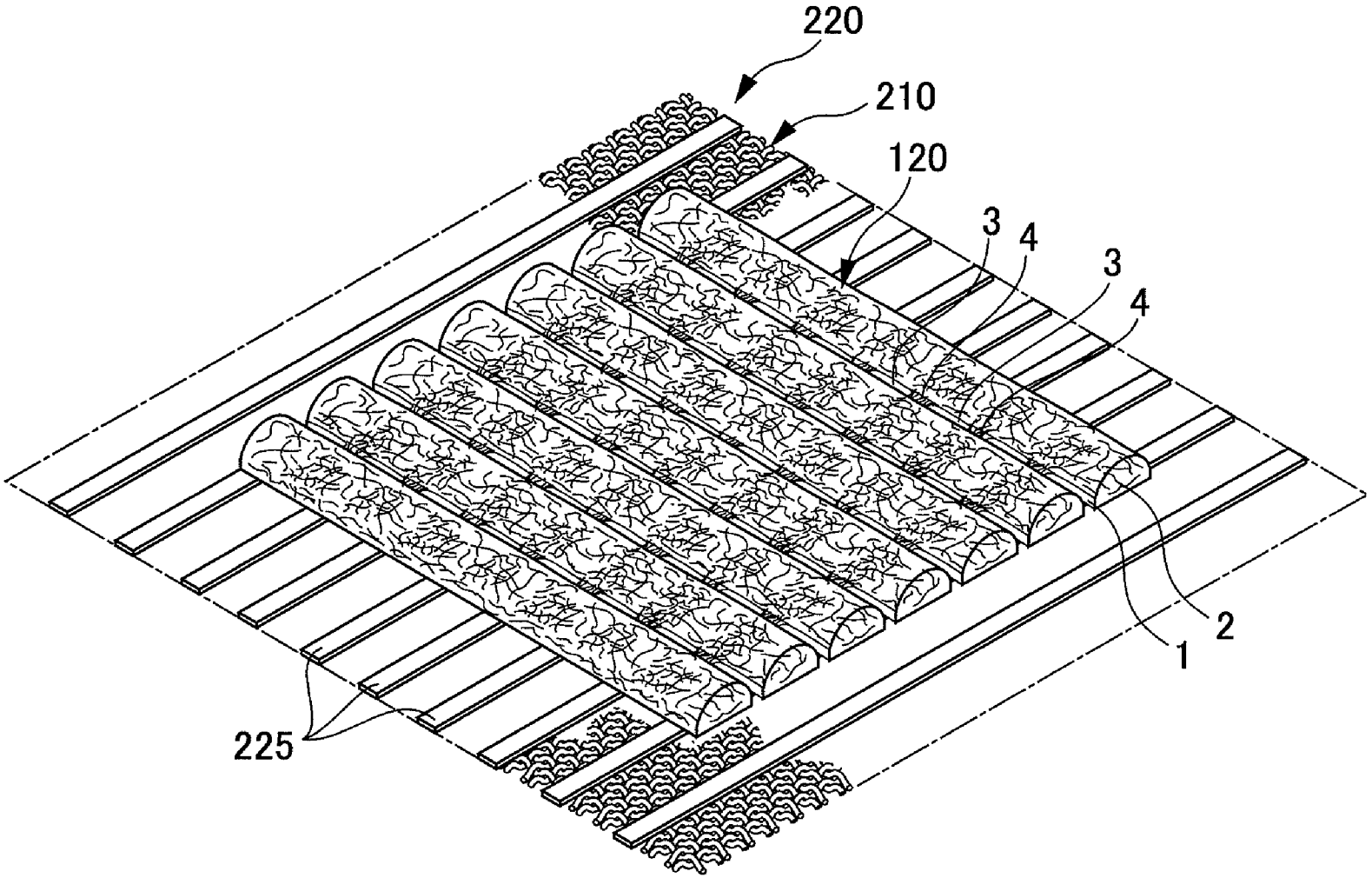
FIG. 5 shows a view of a state of the nonwoven fabric of the first embodiment as described in FIG. 1, produced by blowing a gas onto the top surface of a fiber web in such a way that a bottom face of the fiber web is supported by the support member described in FIG. 3.
Figure 6:
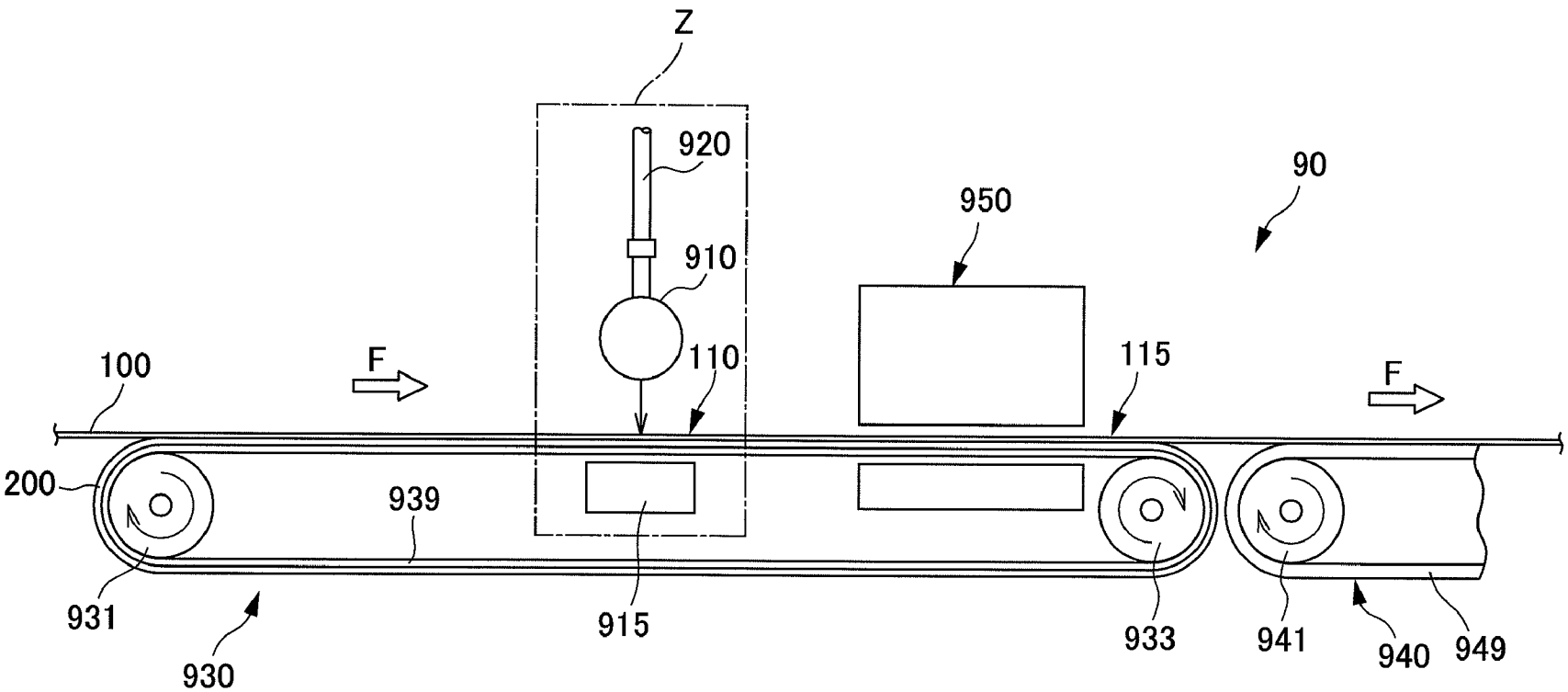
FIG. 6 shows a side view explaining a nonwoven fabric production apparatus according to the first embodiment of the present invention.
Figure 7:
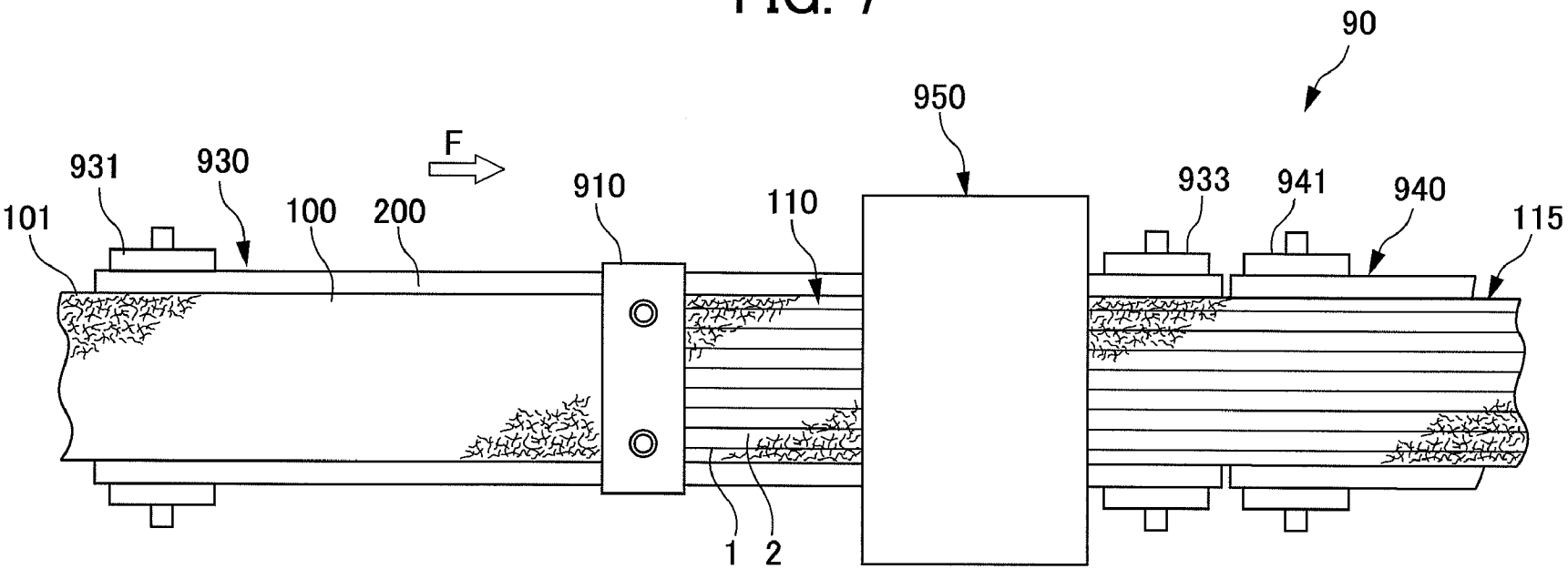
FIG. 7 shows a plan view explaining the nonwoven fabric production apparatus described in FIG. 6.
Figure 8:
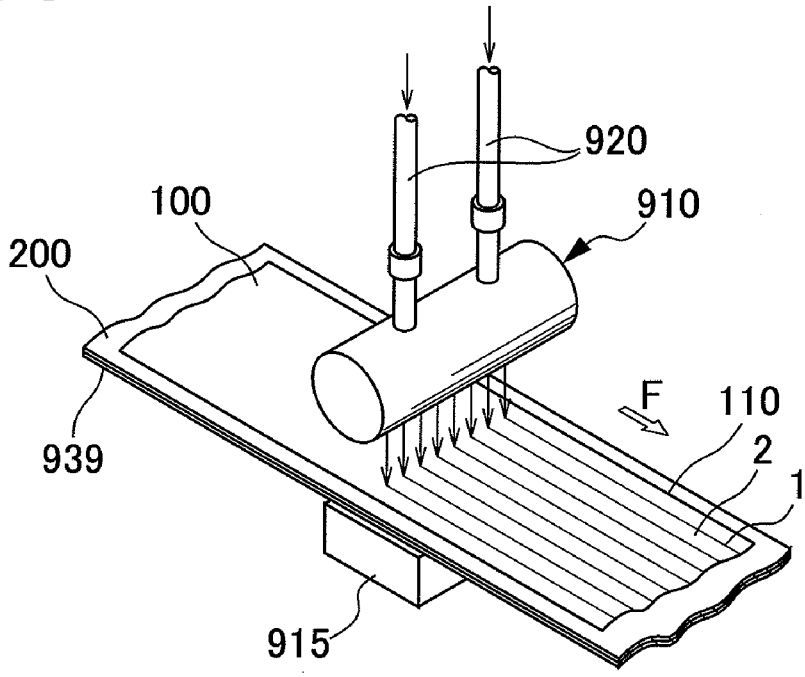
FIG. 8 shows an enlarged perspective view of an area Z as defined in FIG. 6.
Figure 9:
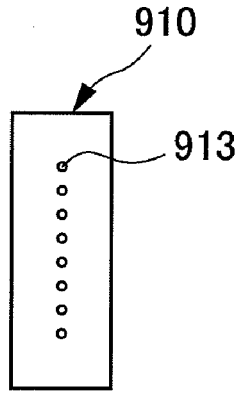
FIG. 9 shows a bottom view of a blowing section described in FIG. 8.
Figure 10A:
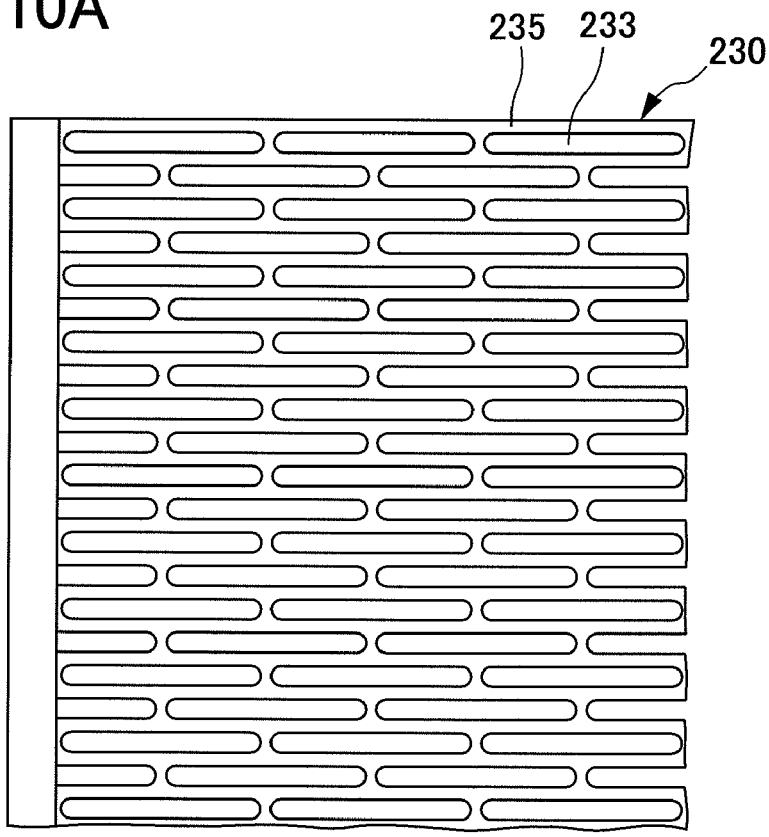
FIG. 10A shows a plan view of a plate-shaped support member formed with a plurality of oval open portions.
Figure 10B:
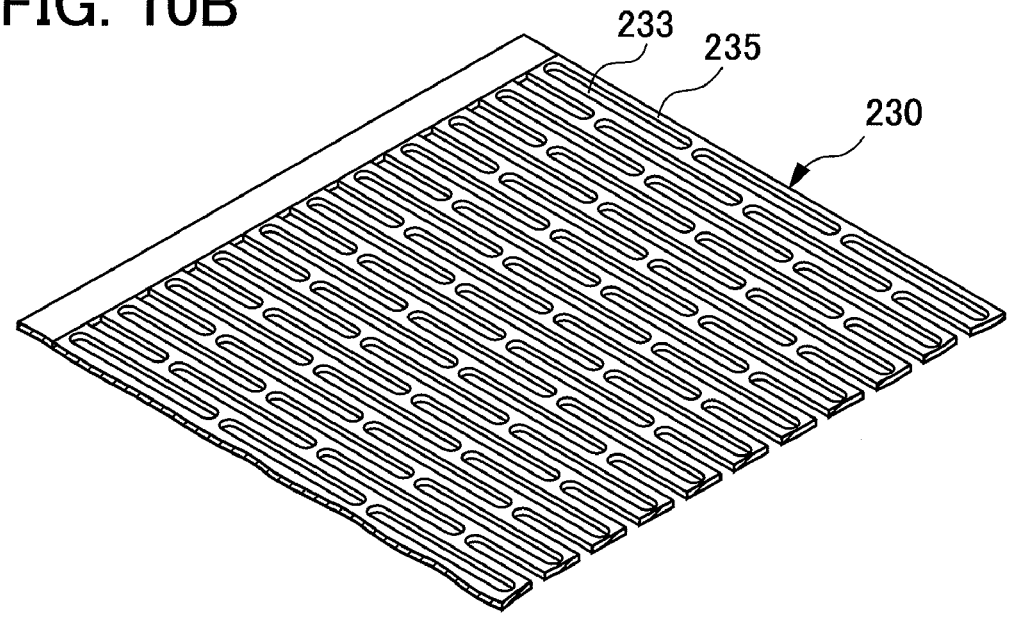
FIG. 10B shows a perspective view of a plate-shaped support member formed with a plurality of oval open portions.
Figure 11:
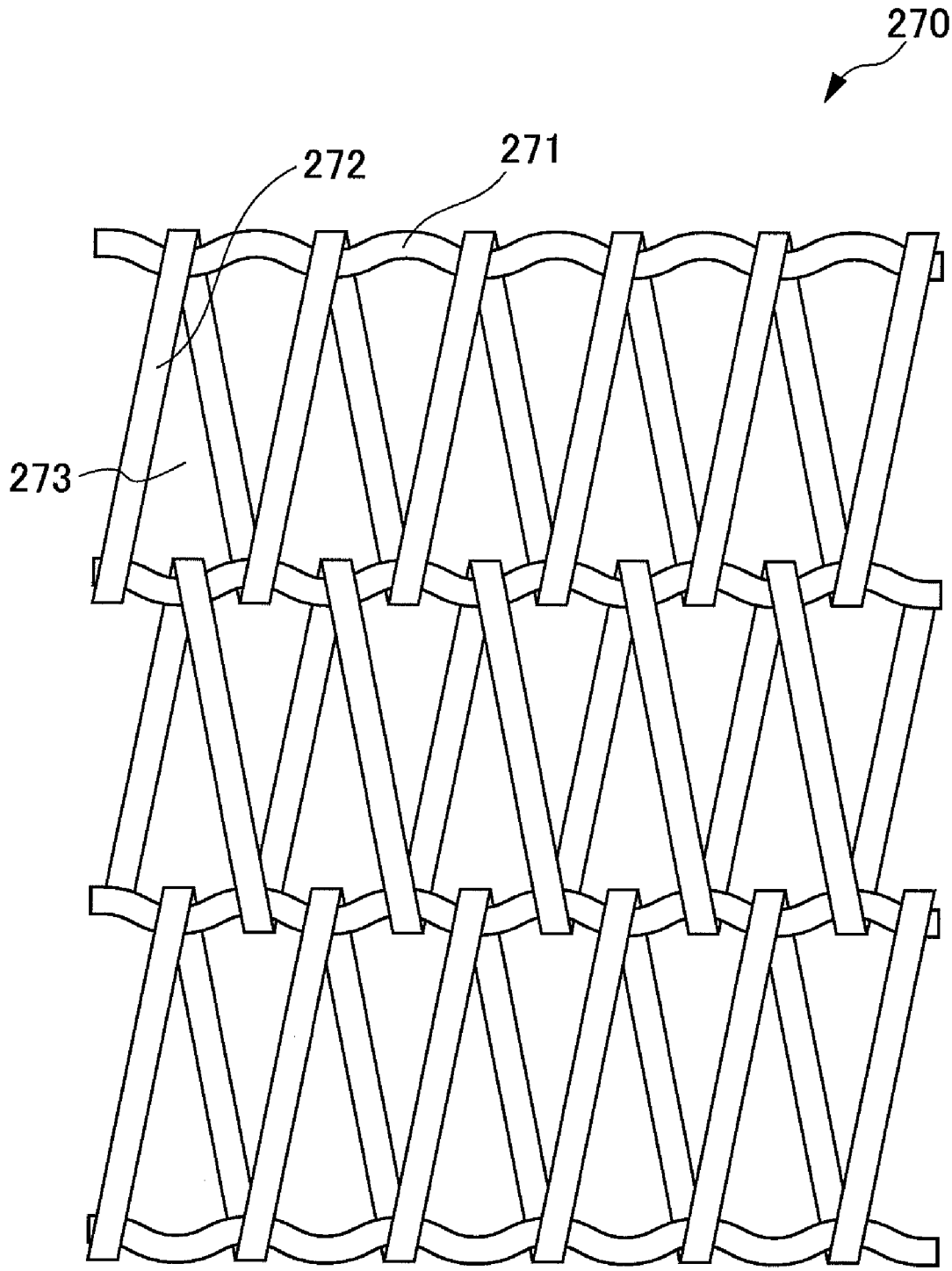
FIG. 11 shows an enlarged plan view and an enlarged perspective view of a support member formed with a plurality of holes at open areas between wires braided in a spiral manner.
Figure 12:
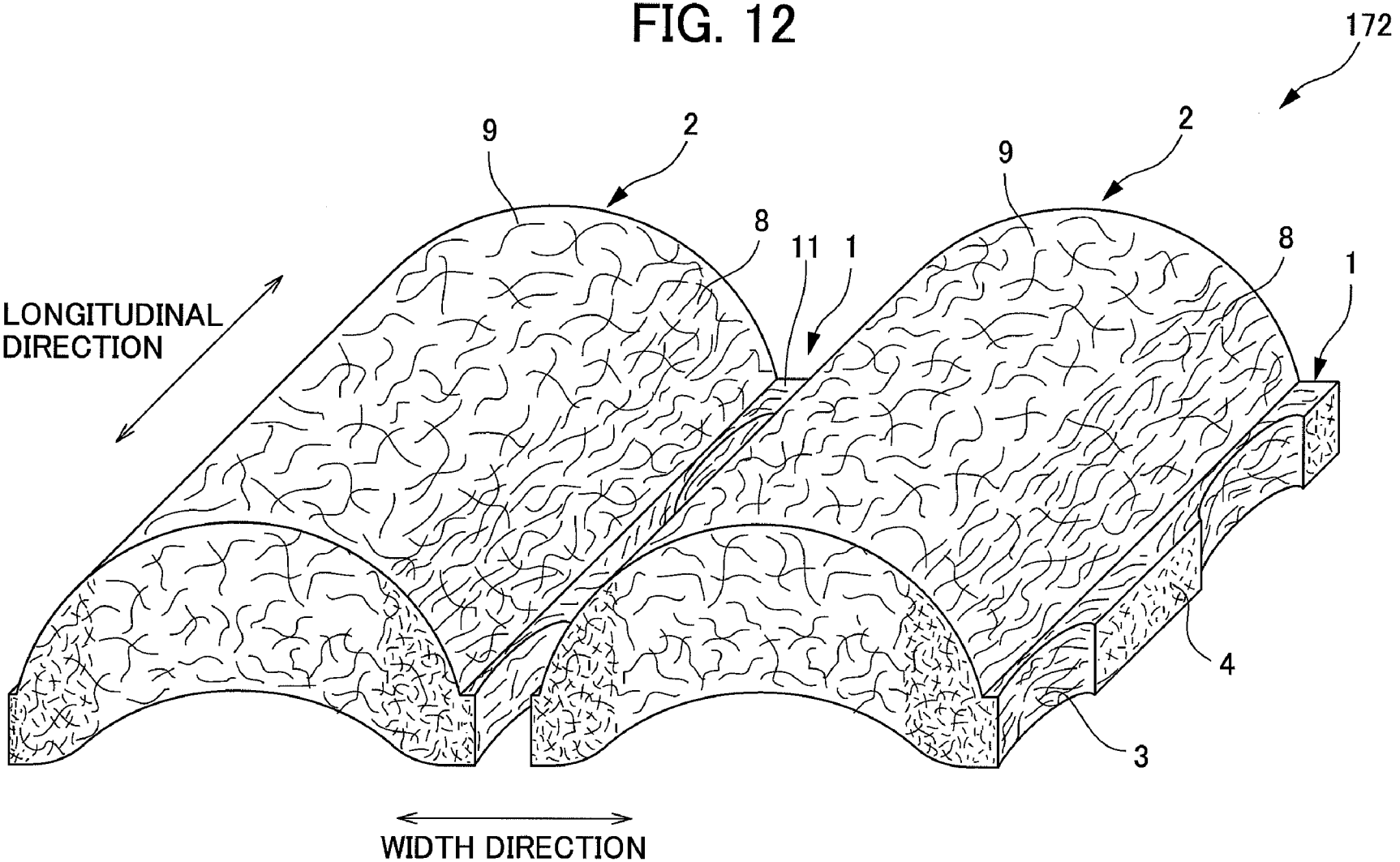
FIG. 12 shows an enlarged perspective view of a nonwoven fabric according to a second embodiment of the present invention.
Figure 13:
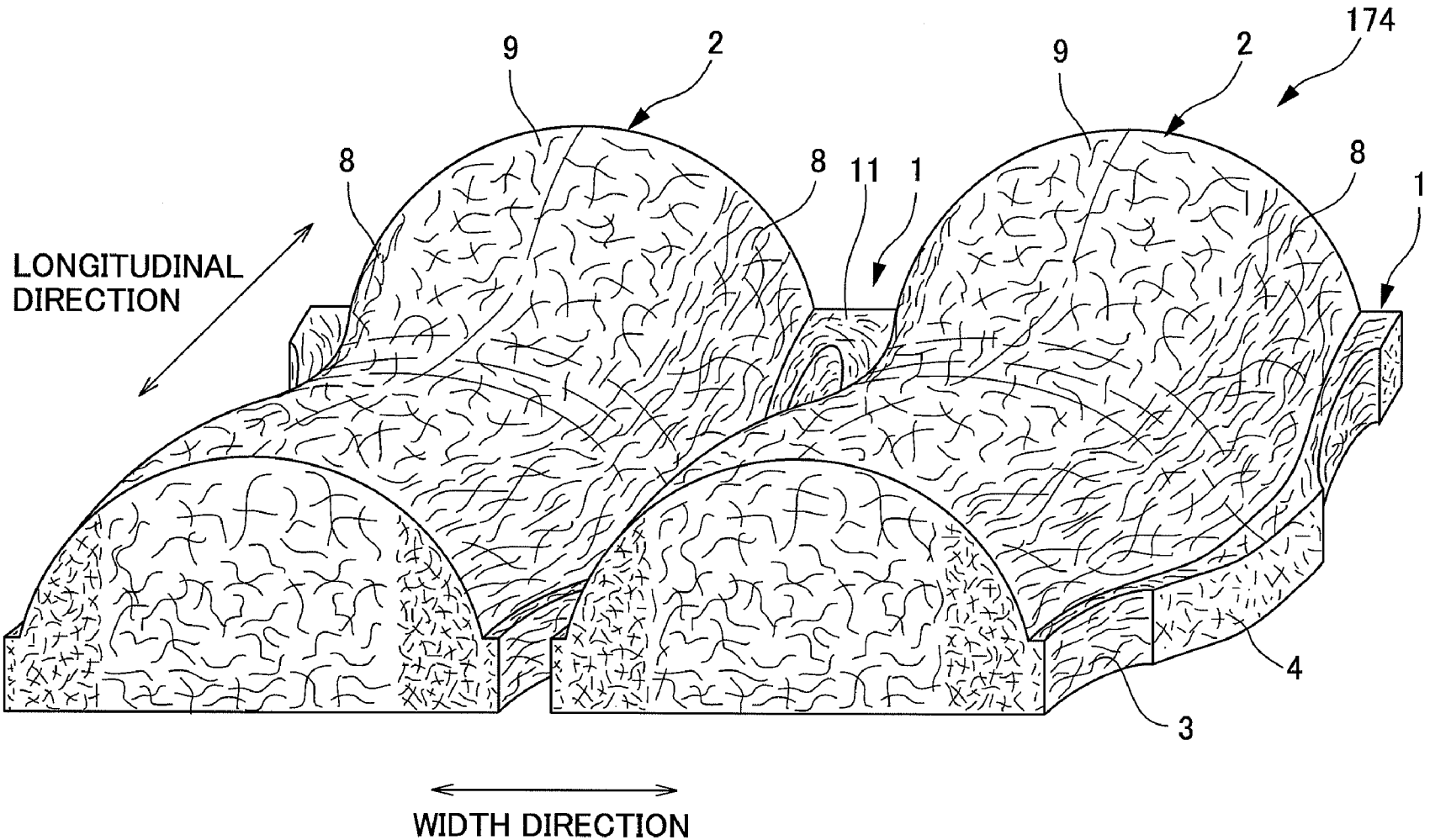
FIG. 13 shows an enlarged perspective view of a nonwoven fabric according to a third embodiment of the present invention.
Figure 14:
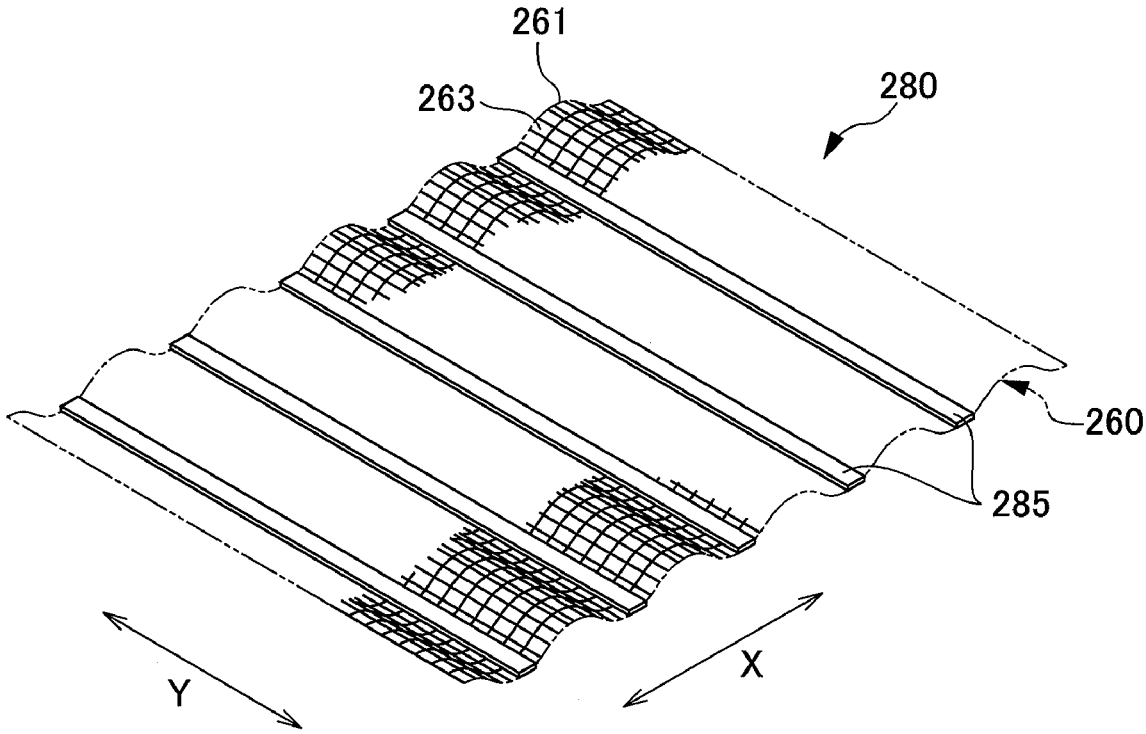
FIG. 14 shows a perspective view of a support member formed by arranging slender members on a mesh support member having wavelike undulations in parallel at even intervals.
Figure 15:
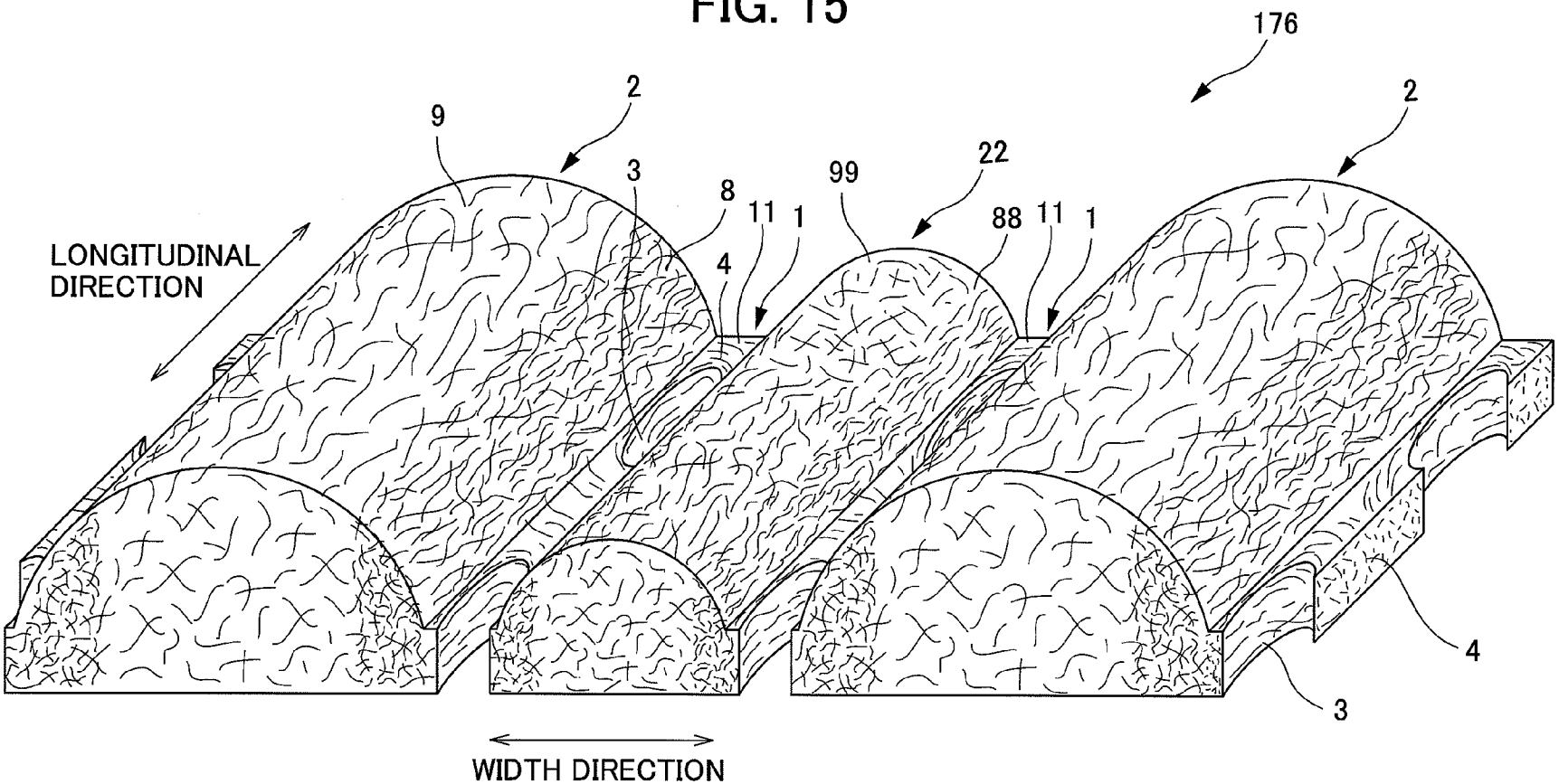
FIG. 15 shows an enlarged perspective view of a nonwoven fabric according to a fourth embodiment of the present invention.
Figure 16:
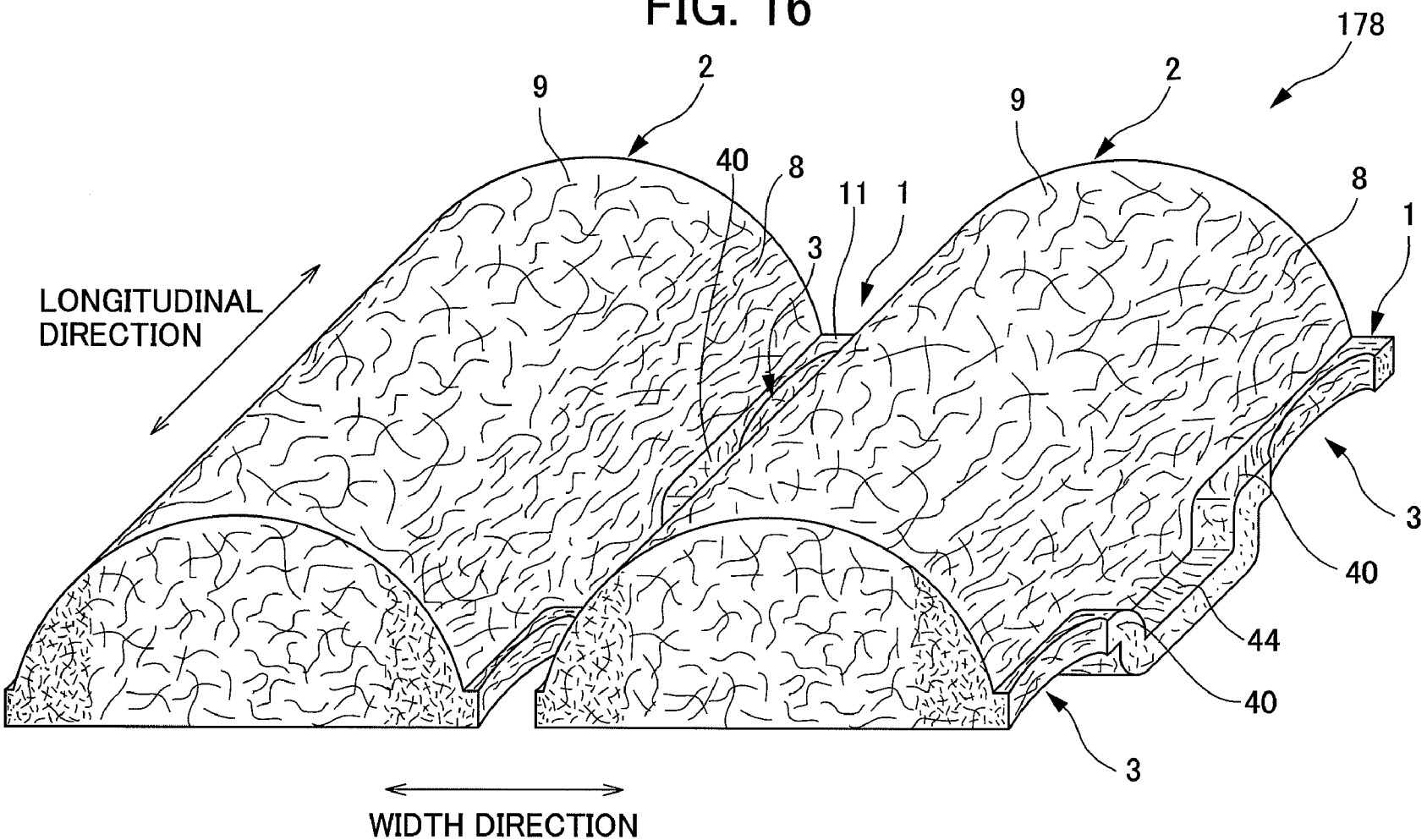
FIG. 16 shows an enlarged perspective view of a nonwoven fabric according to a fifth embodiment of the present invention.
Figure 17:
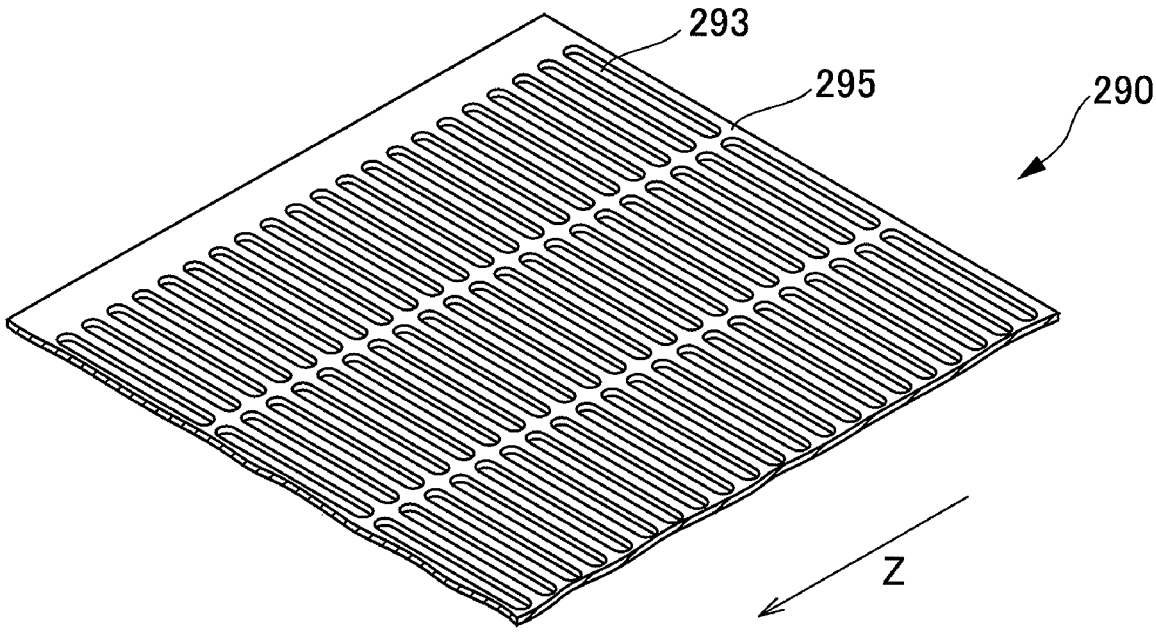
FIG. 17 shows an enlarged perspective view of a plate-shaped support member formed with a plurality of oval open portions in an open condition.
Figure 18:
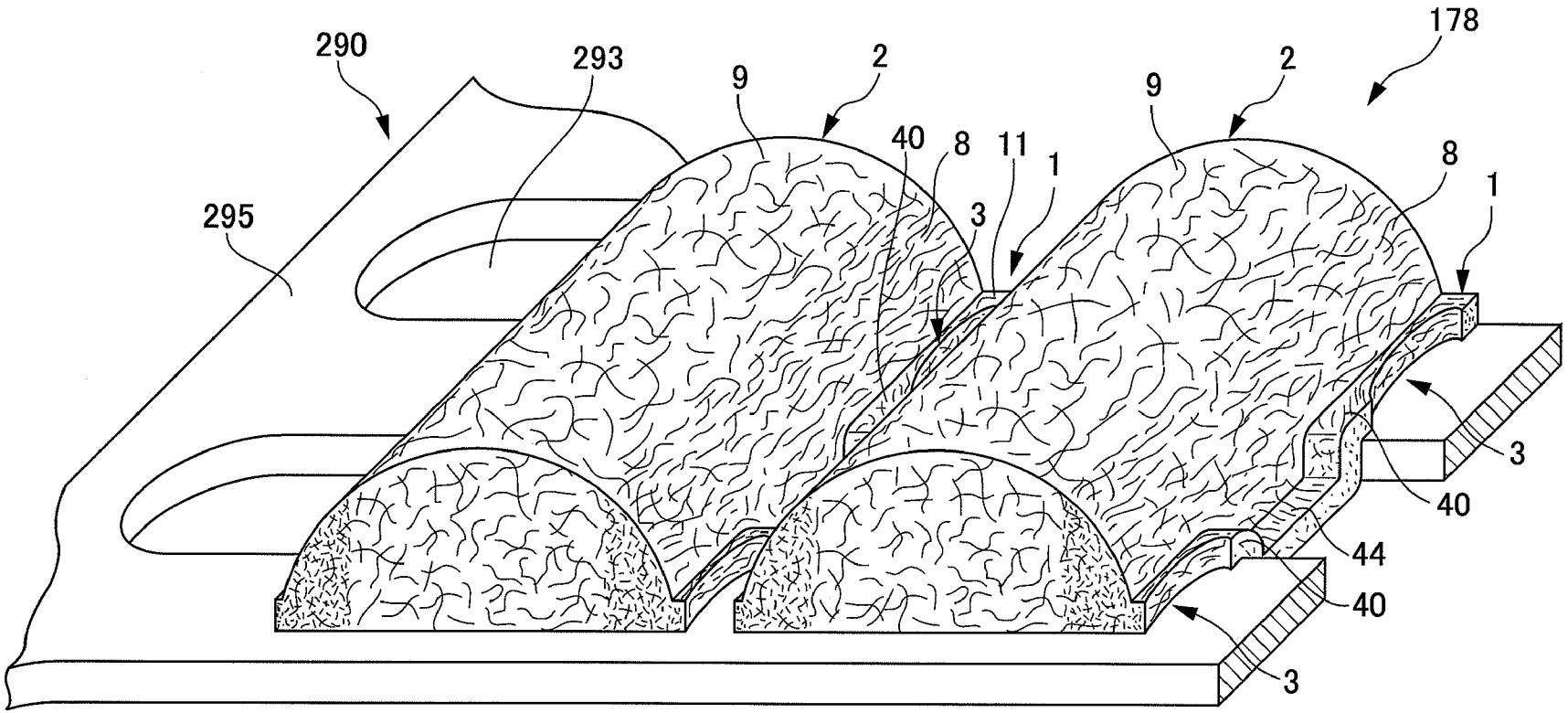
FIG. 18 shows a view of a state of the nonwoven fabric of the fifth embodiment described in FIG. 16, produced by blowing gas onto the top surface of the fiber web in such a way that the bottom face of the fiber web is supported by the support member described in FIG. 17.
Figure 19:
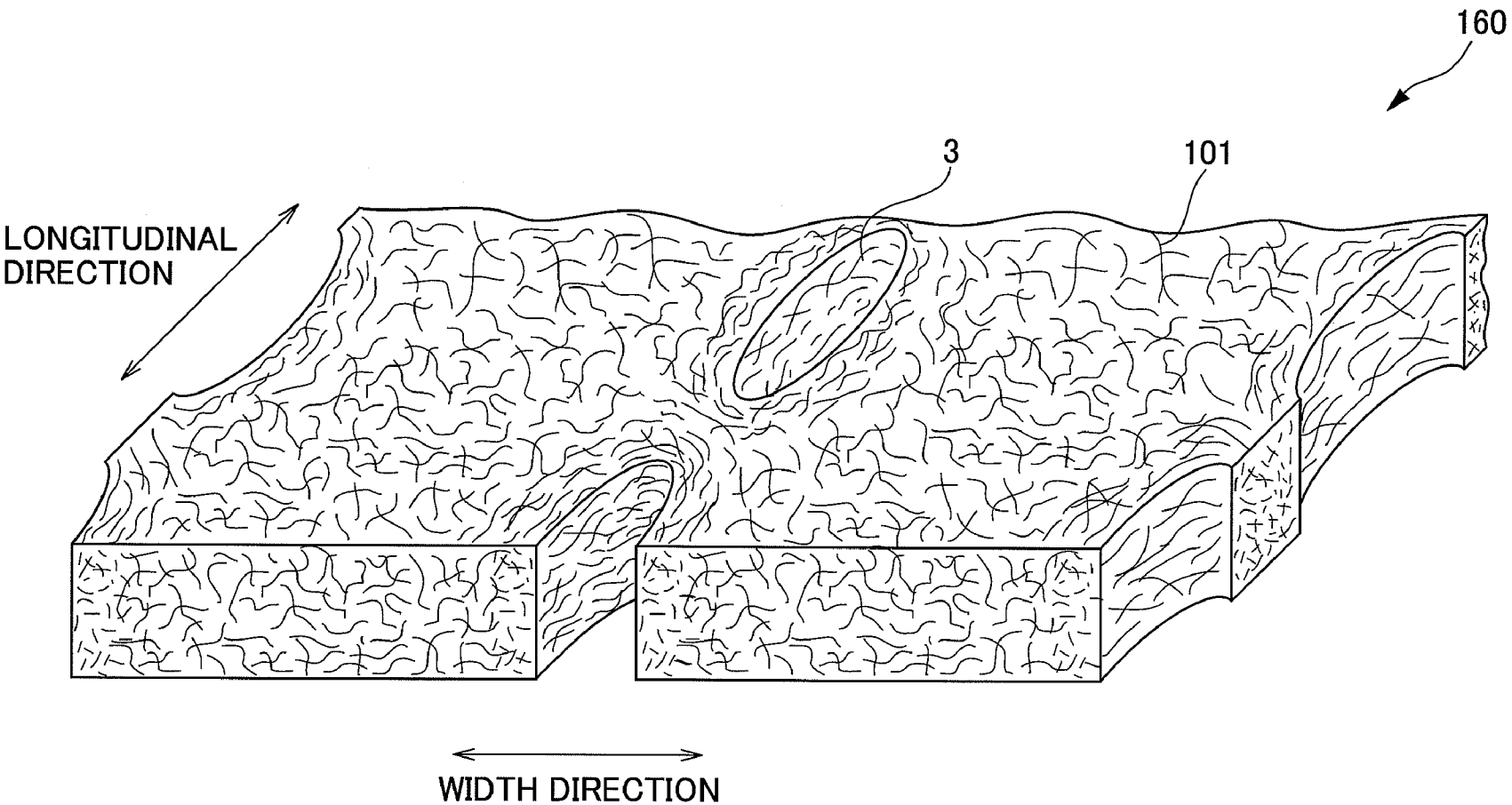
FIG. 19 shows an enlarged perspective view of a nonwoven fabric according to a sixth embodiment of the present invention.
Figure 20:
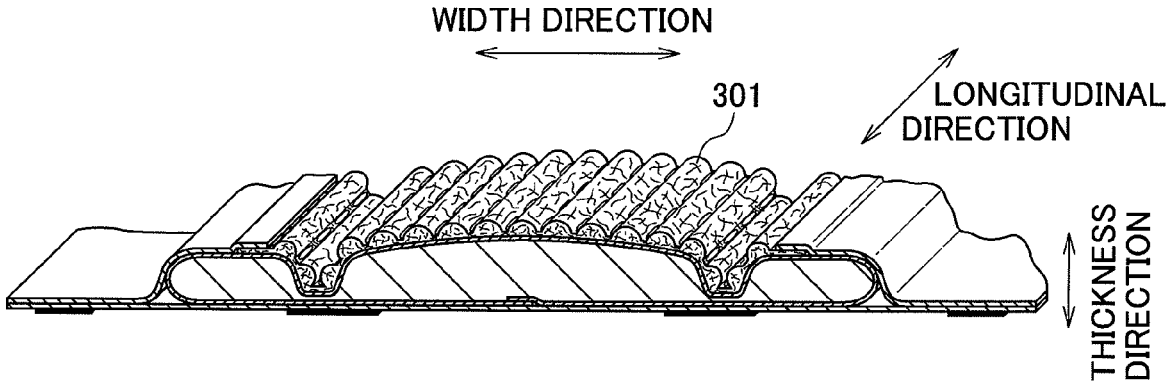
FIG. 20 shows a perspective view when the nonwoven fabric according to the present invention is used for a surface sheet of a sanitary napkin.
Figure 21:
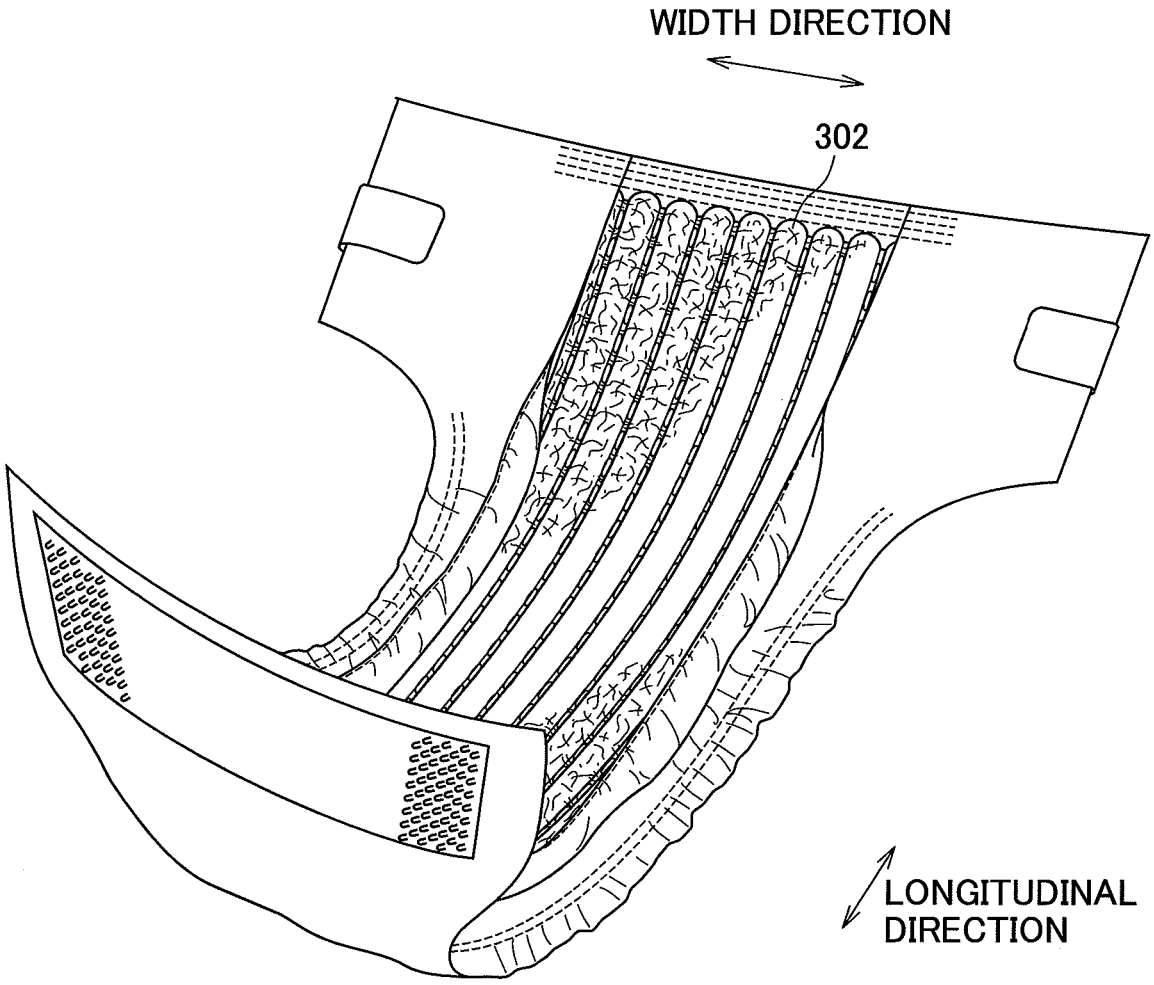
FIG. 21 shows a perspective view when the nonwoven fabric according to the present invention is used for a surface sheet of a diaper.
Figure 22:
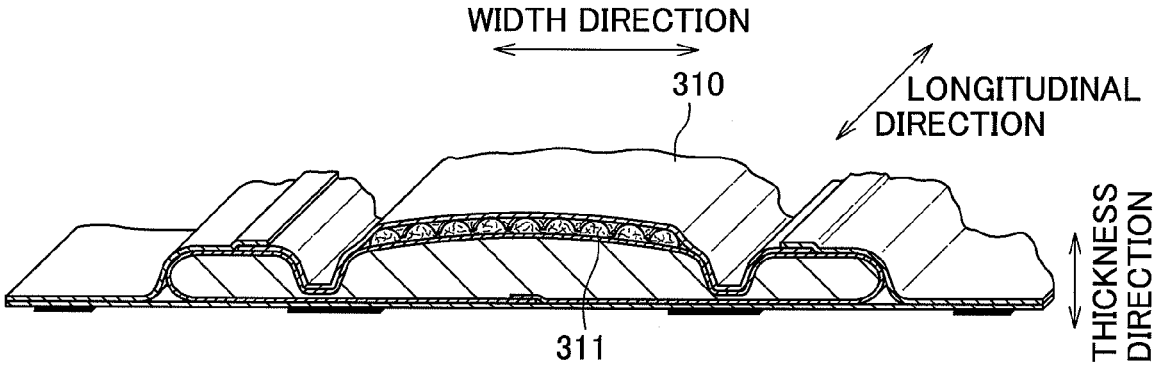
FIG. 22 shows a perspective view when the nonwoven fabric according to the present invention is used as an intermediate sheet of an absorbable product.
Figure 23:
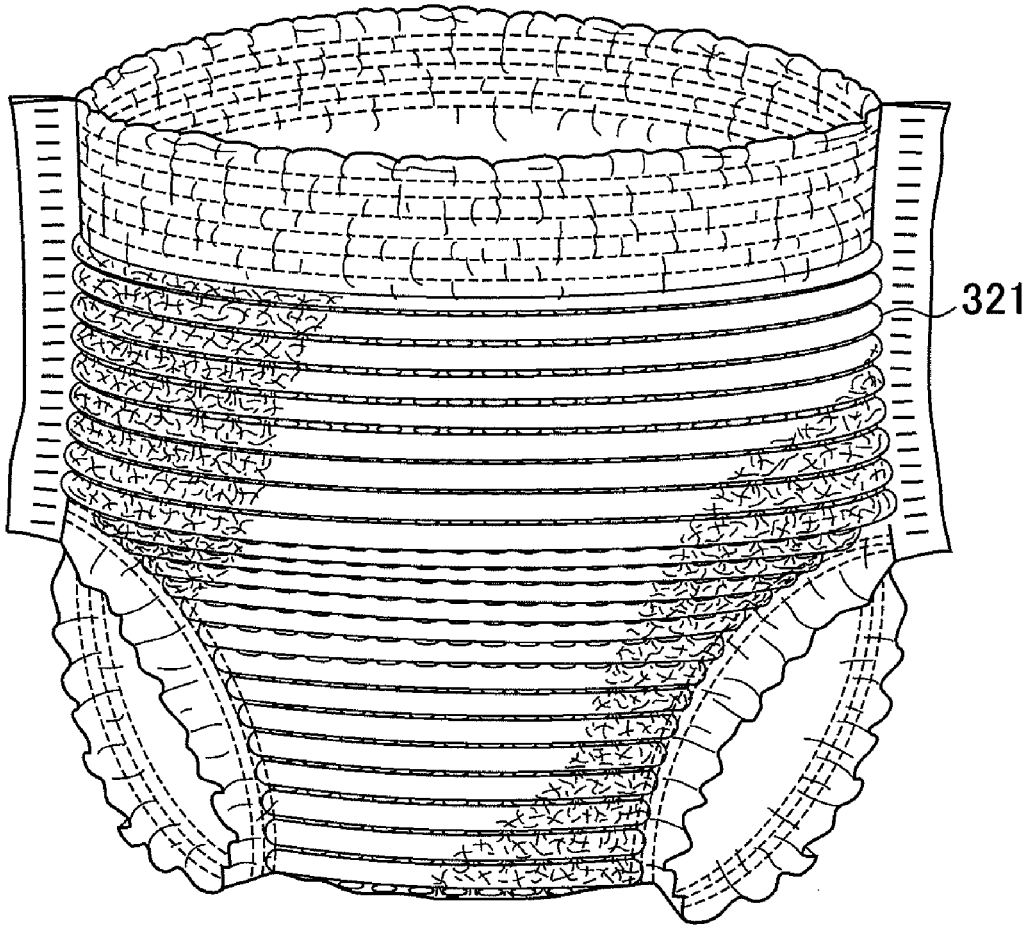
FIG. 23 shows a perspective view when the nonwoven fabric according to the present invention is used as the outermost portion of an absorbable product.

FIG. 1A shows a plan view of a nonwoven fabric according to a first embodiment. FIG. 1B shows a bottom view of a nonwoven fabric according to a first embodiment. FIG. 2 shows an enlarged perspective view of an area Y as defined in FIG. 1. FIG. 3A shows a plan view of a supporting member formed by arranging slender members on a mesh support member in parallel at even intervals. FIG. 3B shows a perspective view of a supporting member formed by arranging slender members on a mesh support member in parallel at even intervals. FIG. 4A shows a plan view of the mesh supporting member described in FIG. 3. FIG. 4B shows a perspective view of the mesh supporting member described in FIG. 3. FIG. 5 shows a view of the nonwoven fabric of the first embodiment described in FIG. 1, produced by blowing gas onto the top surface in such a way that the fiber web is supported on the support member described in FIG. 3. FIG. 6 shows a side view explaining a nonwoven fabric production apparatus according to the first embodiment of the present invention. FIG. 7 shows a plan view explaining the nonwoven fabric production apparatus described in FIG. 6. FIG. 8 shows an enlarged perspective view of an area Z as defined in FIG. 6. FIG. 9 shows a bottom view of a blowing section described in FIG. 8. FIG. 10A shows a plan view of a plate-shaped support member formed with a plurality of oval open portions. FIG. 10B shows a perspective view of a plate-shaped support member formed with a plurality of oval open portions. FIG. 11 shows an enlarged plan view and an enlarged perspective view of a support member formed with a plurality of holes at open areas between wires braided in a spiral manner. FIG. 12 shows an enlarged perspective view of a nonwoven fabric according to a second embodiment of the present invention. FIG. 13 shows an enlarged perspective view of a nonwoven fabric according to a third embodiment of the present invention. FIG. 14 shows a perspective view of a support member formed by arranging slender members on a mesh support member having wavelike undulations in parallel at even intervals. FIG. 15 shows an enlarged perspective view of a nonwoven fabric according to a fourth embodiment of the present invention. FIG. 16 shows an enlarged perspective view of a nonwoven fabric according to a fifth embodiment of the present invention. FIG. 17 shows an enlarged perspective view of a plate-shaped support member formed with a plurality of oval shaped open portions in an open condition. FIG. 18 shows a view of a state of the nonwoven fabric of the fifth embodiment as described in FIG. 16, produced by blowing gas onto the top surface in such a way that the fiber web is supported on the support member described in FIG. 17. FIG. 19 shows an enlarged perspective view of a nonwoven fabric according to a sixth embodiment of the present invention. FIG. 20 shows a perspective view when the nonwoven fabric according to the present invention is used for a surface sheet of a sanitary napkin. FIG. 21 shows a perspective view when the nonwoven fabric according to the present invention is used for a surface sheet of a diaper. FIG. 22 shows a perspective view when the nonwoven fabric according to the present invention is used as an intermediate sheet of an absorbable product. FIG. 23 shows a perspective view when the nonwoven fabric according to the present invention are used as the outermost portion of an absorbable product.

The nonwoven fabric according to the present invention is a nonwoven fabric formed with at least predetermined open portions.

1. First Embodiment

FIGS. 1 to 11 describe a nonwoven fabric of a first embodiment according to the present invention.

1.1. Shape

As shown in FIGS. 1A, 1B, FIG. 2 or FIG. 5, the nonwoven fabric 120 is a nonwoven fabric formed with a plurality of open portions 3. Specifically, the nonwoven fabric 120 is constituted so that a plurality of grooves 1 are formed in parallel at roughly even intervals along a longitudinal direction which is a first direction on a first surface side of the nonwoven fabric 120, and is formed with a plurality of open portions 3 in the grooves 1. Each of the plurality of open portions 3 is formed into a substantially circular or substantially oval shape. This embodiment describes that the grooves 1 are formed in parallel at substantially equal intervals, however, is not limited to this. For example, the grooves may be formed for each different interval, or formed so that intervals between the grooves 1 are different.

At respective spaces between the plurality of grooves 1, a plurality of convex portions 2 are formed. The convex portions 2 are formed in parallel at substantially even intervals in the same way as for the grooves 1. The convex portions 2 in the nonwoven fabric 120 of this embodiment have a substantially uneven height (thickness), however, the convex portions 2 adjacent to each other may be formed so as to have a different height. For example, by adjusting the intervals of the nozzle holes 913 for blowing fluid, composed mainly of gas, as described later, the height of each of the convex portions 2 can be adjusted. For example, by decreasing the intervals between the nozzle holes 913, the height of the convex portions 2 can be decreased. On the other hand, by increasing the intervals between the nozzle holes 913, the height of the convex portions can be increased. Furthermore, by alternately establishing small and large intervals between the nozzle holes, convex portions 2 with different heights may be alternately formed. In addition, an advantage is provided in that partial differences in the height of the convex portions can reduce skin contact area, thus reducing the burden on the skin.

In this embodiment, each of the convex portions 2 is formed so as to have a greater height in the thickness direction of the nonwoven fabric 120 than the groove portion 1. Specifically, the height is 0.3 to 15 mm, preferably 0.5 to 5 mm as an example. Moreover, the horizontal length of each of the convex portions 2 in the width direction is 0.5 to 30 mm, preferably 1.0 to 10 mm as an example. Furthermore, the distance between the convex portions 2 adjacent to each other across the groove portion 1 is 0.5 to 30 mm, preferably 3 to 10 mm as an example.

The height of each of the groove portions 1 in the thickness direction of the nonwoven fabric 120 is formed so as to be less than that of each of the convex portions 2. Specifically, the height of the groove portion is no greater than 90% of that of the convex portion 2 in the thickness direction, preferably 1 to 50% and more preferably, 0 to 20%. A height of 0% in the thickness direction indicates that it is an open portion 3.

The length of the groove 1 in the width direction is, for example, 0.1 to 30 mm, preferably 0.5 to 10 mm as an example. The distance between the groove portions 1 adjacent to each other across the convex portion 2 is 0.5 to 20 mm, preferably 3 to 10 mm as an example.

As an example, when the nonwoven fabric 120 is used as a surface sheet for an absorbable product, such a design allows the groove portion 1 to be suitably formed to improve the surface resistance to even large amounts of excreted liquid. Moreover, this makes it easy to maintain spaces formed by the groove portions 1 even in situations where the convex portion 2 is crushed by an externally applied excessive pressure and hence enables the surface of the nonwoven fabric to become more resistant to a specific amount of excreted liquid. Furthermore, even if a specific amount of liquid absorbed in an absorber or the like, is reversed as a result of an external pressure, the presence of a rough surface on the nonwoven fabric may make it difficult for the desorbed liquid to reattach onto the skin due to the low contact area with the skin.

A measuring method for the height, pitch and width of the groove portion 1 or the convex portion 2 is explained as follows. As an example, the nonwoven fabric 120, in the absence of an applied external pressure, is placed on a table, then sectional photographs or sectional images of the nonwoven fabric 120 are taken with a microscope and dimensions are determined from these images.

Measurement of the height (the distance in the thickness direction) is made by taking the highest position of each of the convex portion 2 and the groove portion 1 running upward from the lowest position (namely, a table surface) of the nonwoven fabric 120, as a height thereof.

Measurement of the pitch between the convex portions 2 is made by measuring the distance between the central position of the convex portions 2 adjacent to each other.

Measurement of the pitch between the groove portions 1 is made by measuring the distance between the central positions of the convex portions 1 adjacent to each other.

Measurement of the width of the convex portion 2 is made by measuring the greatest width of the bottom face of the convex portion 2 upward from the lowest position (or the table surface). Measurement of the groove portion 1 is made in the same way as the above.

There is no particular limitation to the shapes of the raised ridge portions 2. For example, dome shapes, trapezoid shapes, triangular shapes, Ω-like shapes and square shapes are all possible. To allow good skin contact, it is desirable that the portion around the top of and the side face of the convex portion 2 include a curved surface. To maintain a space between the groove portions 1, even if the convex portion 2 is crushed by an external pressure, it is preferable that the convex portion 2 have a smaller width as the convex portion 2 runs toward the top face from the bottom face thereof. Preferably, the top face of the convex portion 2 has a curved line (face) of a rough dome shape or the like.

As shown in FIG. 1A, 1B, and FIG. 2, the nonwoven fabric 120 according to this embodiment is a nonwoven fabric formed with a plurality of open portions 3 in the groove portions 1. Each of the plurality of open portions 3 is formed into a substantially circular or substantially oval shape. Between the plurality of open portions 3, the joining portions 4 are formed so as to connect the convex portions 2 adjacent to the groove portions 1 with each other. In other words, the plurality of joining portions 4 formed at predetermined intervals connect the convex portions 2 with the adjacent convex portions 2.

In this embodiment, the open portions 3 are formed at substantially equal intervals, however this should not be considered limiting and the open portion 3 may be formed at different intervals.

Both of the lengthwise length of the open portion 3 in the first direction and the lateral length in the second direction are 0.1 to 5 mm, preferably 0.5 to 4 mm as a example. Each of the pitches of the open portions 3 adjacent to each other and across the joining portions 4 is 0.5 to 30 mm, preferably 1 to 10 mm as an example.

The height of each of the joining portions 4 in the thickness direction of the nonwoven fabric 120 is equal to or less than that of each of the projection portions 2 in the thickness direction of the nonwoven fabric 120, preferably 20 to 100% and more preferably, 40 to 70% as an example. The length of each of the joining portions 4 in the longitudinal direction of the nonwoven fabric 120 and the length in the width direction is 0.1 to 5 mm, preferably 0.5 to 4 mm as an example. Each of pitches between the tops of the joining portions 4 adjacent to each other and across the open portions 4 is 0.5 to 30 mm, preferably 1 to 10 mm as an example.

The cross-sectional shape of each of the joining portions 4 in the longitudinal direction of the nonwoven fabric is formed into a substantially square shape. The cross-sectional shape of each of the joining portions 4 in the longitudinal direction is not limited to a substantially square shape. The shapes such as dome shapes, trapezoid shapes, triangular shapes and Ω-like shapes are all possible. To prevent a predetermined liquid from spreading in the groove portions 1, a substantially square shape is preferable. Moreover, the top of the joining portion 4 is preferably flat or curved so as not to the joining portion 4 giving a foreign body sensation by touching the skin or the like under an excessive external pressure.

1.2. Fiber Orientation

As shown in FIG. 2, the nonwoven fabric 120 is formed with areas having different percent contents of longitudinally oriented fiber oriented in a longitudinal direction as a first direction. In other words, areas having different percent contents of laterally oriented fiber oriented in a width direction as a second direction. The various areas may indicate the following locations, for example, the groove portion 1, a side portion 8 of the convex portion 2, a central portion 9 sandwiched between the adjacent side portions and the like.

The orientation of the fiber 101 in a first direction (longitudinal direction) means that the fiber 101 is oriented in the first direction, or oriented within the range of −45 degrees to +45 degrees to a predetermined longitudinal direction as such a direction (Machine Direction) that the nonwoven fabric or fiber web is passed through a machine producing the nonwoven fabric. The fiber oriented in the first direction is referred to as longitudinally oriented fiber. The orientation of the fiber 101 in a second direction (width direction in nonwoven fabric) means that the fiber 101 is oriented in the second direction, or oriented within the range of −45 degrees to +45 degrees to a predetermined width direction as such a direction (Cross Direction) orthogonal to Machine Direction. The fiber oriented in the second direction is referred to as laterally oriented fiber.

The side portion 8 is an area corresponding to either of both sides of the convex portion 2, and the fiber 101 in the side portion 8 is formed so that the fiber oriented in a direction along the longitudinal direction of the convex portion 2 may increase. For example, the fiber 101 in the side portion 8 has a larger content of fiber oriented in the longitudinal direction compared to that of the longitudinally orientated fiber in the central portion 9 (an area between both the side portions 8) of the convex portion 2. For example, the percent content of the longitudinally oriented fiber in the side portion 8 is 55 to 100%, preferably 60 to 100% as an example. When the percent content of the longitudinally oriented fiber is less than 55%, nonwoven fabric is pulled by an apparatus in producing the nonwoven fabric, so that the side portion 8 is sometimes enlarged. When the side portion 8 is further enlarged, the groove portion 1 and the central portion 9 described later are also sometimes enlarged as the result of the nonwoven fabric being pulled by the apparatus.

The central portion 9 is an area between the side portions 8 as both sides of the convex portion 2 and an area with a lower percent content of longitudinally oriented fiber compared to that of the side portion 8. Preferably, the central portion 9 has longitudinally oriented fiber and laterally oriented fiber blended appropriately.

For example, the percent content of longitudinally oriented fiber in the central portion 9 is established so as to be at least 10% less than that in the side portion 8 and at least 10% greater than that in bottom 11 of the groove portion 1. Specifically, it is preferable that the percent content of longitudinally oriented fiber is the range of 40 to 80%.

The groove portion 1, which is formed by direct blowing of a fluid mainly composed of gas, such as hot air, is an area in which the open portion 3 and the joining portion 4 are formed. When fluid mainly composed of gas is blown, a portion which receives the blown fluid, mainly composed of gas, is recessed in the thickness direction, and the fiber 101 oriented in the longitudinal direction (longitudinally oriented fiber) is shifted to the side portion 8 side by the force of the blowing fluid. The fiber 101 oriented in the cross direction (laterally oriented fiber) is shifted to the joining portion 4 side by the blowing fluid, mainly composed of gas, and/or the blowing fluid, mainly composed of gas, which is blown over an impermeable portion of the supporting member 220 described later to change the flowing direction of the gas. In such a way, the fiber 101 in the joining portion 4 of the groove portion 1 is oriented in a direction crossing the longitudinal direction of the groove portion 1, specifically, in a wholly width direction. Therefore, the fiber 101 in the peripheral edge of the open portion 3 is oriented along an open shape.

As a result, the joining portion 4 of the groove portion 1 has the lowest percent content of longitudinally oriented fiber in the nonwoven fabric 120. In other words, the joining portion 4 has the highest percent content of laterally oriented fiber. Specifically, the percent content of laterally oriented fiber is established so as to be 55 to 100%, preferably, 60 to 100%. If a percent content of laterally oriented fiber is less than 55%, it is difficult to increase the strength of the nonwoven fabric in the width direction because the position of a weight on the groove portion 1 is low. For example, if the nonwoven fabric is used as a surface sheet of an absorbable product, there is a risk that slippage or breakage may occur in the width direction due to friction with the human body during use of the absorbable product.

Following is an outline of the method used to measure fiber orientation with a digital microscope VHX-100 made by Keyence Corporation. (1) Set a sample so that the longitudinal direction is in the proper direction on the observation stage. (2) Focus the lens on the fibers at the front of the sample, excluding the fibers that irregularly protrude to the front. (3) Set photographic depth (to the back) and create a 3D image on a PC monitor. Next, (4) convert the 3D image into a 2D image. (5) Draw a plurality of equally spaced, parallel lines on the monitor at any suitable time in the longitudinal direction in the range to measure. (6) In each fragmented cell drawn with parallel lines and observe whether the fiber orientation is in the first direction (longitudinal direction) or in the second direction (width direction) then measure the number fibers facing each direction. Then, (7) calculate the ratio of the number of fibers in the fiber orientation facing the first direction (longitudinal direction) and the ratio of the number of fibers in the fiber orientation in the second direction (width direction) for the entire number of fibers in the set range to measure and calculate.

1.3. Fiber Sparsity and Density

As shown in FIG. 2, the convex portion 2 is adjusted so that the average fiber density may be greater than that of the groove portion 1. A fiber density of the convex portion 2 can be arbitrarily adjusted according to various conditions such as the quantity or tension of fluid mainly composed of gas (for example, hot air).

A fiber density of the convex portion 2 is, for instance, 0.005 to 0.20 g/cm$^3$, preferably, 0.007 to 0.07 g/cm$^3$ as an example. If the fiber density of the convex portion 2 is less than 0.005 g/cm$^3$, the convex portion 2 is not only susceptible to be crushed by the empty weight of liquid included in the convex portion 2 or an external pressure, but absorbed liquid is able to leach from the absorbent under pressurized condition. On the other hand, if the fiber density of the convex portion 2 is greater than 0.20 g/cm$^3$, liquid brought to the convex portion 2 has difficulty in traveling downward, so that the liquid gathers on the convex portion 2, thus sometimes causing a user to have a wet feeling.

The groove portions 1 are adjusted so that their average fiber density may be less than that of the convex portions 2. The average fiber density of the whole groove portion 1 is specifically 0.002 to 0.18 g/cm$^3$, preferably, 0.005 to 0.05 g/cm$^3$ as an example. In the case where the aver age fiber density of the whole groove portion 1 is less than 0.002 g/cm$^3$, for example, the nonwoven fabric 120, when used in an absorbable product, may be easily damaged. In the case where the average fiber density of the whole groove portion 1 is greater than 0.18 g/cm$^3$, liquid has difficulty in traveling downward, so that the liquid gathers on the bottom of the groove portion 1, thus sometimes causing a user to have a wet feeling. A fiber density of the bottom of the groove portion 1 can be arbitrarily adjusted according to various conditions such as the quantity or tension of fluid, mainly composed of gas (for example, hot air).

A fiber density of the joining portion 4 in the groove portion 1 is 0.005 to 0.20 g/cm$^3$, preferably, 0.007 to 0.10 g/cm$^3$ as an example. Where the fiber density of the joining portion 4 is less than 0.005 g/cm$^3$, the joining portion 4 as well may be crushed when the convex portion 2 is crushed by an excessive external pressure.

On the other hand, where a fiber density of the jointing portion 4 is greater than 0.20 g/cm$^3$, the predetermined liquid dropped onto the groove portion 1 will gather on the joining portion 4 and, if an excessive external pressure is applied to the nonwoven fabric 120 and the liquid comes into direct contact with the skin, a wet feeling may result.

The nonwoven fabric 120 is formed so that a percent open area measured from a face which is formed with the groove portions 1 and the convex portions 2 as one side in the thickness direction of the nonwoven fabric 120 may be less than that measured from the other side as a face on the opposite side to a face which is formed with the groove portions 1 and the convex portions 2.

A fiber web 100 conveyed on a supporting member 220 described later has a tendency that the fiber 101 moves, by gravity, to one side opposite to a face blown with fluid, mainly composed of gas, so that the distance between fibers positioned near the face on the opposite side becomes less. On the other hand, the distance between the fibers has a tendency of becoming greater as the fiber moves closer to the side over which fluid, mainly composed of gas, is blown.

By further blowing fluid, mainly composed of gas, the fibers 101 on the side near the supporting member 220 are pressed against the supporting member 220, some of which face the plane direction of the supporting member 220. Thus, the distance between the fibers is further decreased, so that the fibers become closer to each other. Under such a state, the fibers become thermally fused to each other by heat treatment such as oven treatment, so that the degree of freedom of the fibers 101 is low and a percent open area between the fibers on the other side in the nonwoven fabric 120 also becomes low.

On the other hand, the fibers are not excessively crushed against each other from the face of the supporting member 220 toward the face blown with fluid, mainly composed of gas. In the convex portion 2, the blown fluid, mainly composed of gas, hits the supporting member 220 and is redirected, by which some of the fibers 101 are directed so as to be partially perpendicular to the supporting member 220. Under such a state, the fibers are thermally fused to each other, thus increasing the percent open area between the fibers.

The percent open area used herein refers to a percentage of the open area without fiber to the total area.

Following is an outline of the method used to measure percent open area with a digital microscope VHX-100 made by Keyence Corporation. First, (1) set a sample on the measuring instrument so that the direction along the groove portion 1 and the convex portion 2 is in a longitudinal direction on a bench, and (2) in the top of the convex portion 2, make the following measurement from a projecting surface of the convex portion 2 and a surface on the opposite side to the projecting surface, respectively.

(3) Set the lens magnification of the measuring instrument and the magnification on a personal computer screen to an appropriate level and then focus the lens on the nearest fiber of the sample, excluding fibers that irregularly project to the front. (4) Define an appropriate shooting depth and prepare a 3D image of the sample.

(5) Convert the 3D image into 2D image to allow 2D processing to defined the volume and identify the space between fibers within the specified range. Furthermore, (6) the 2D image is converted into a binary image where the area occupied by fibers is converted into white and the area not occupied by fibers is converted into black. Then (7) reverse the color to turn the area not occupied by fibers into white, and measure the white area.

With a magnification of 300 times and a shooting depth of 220 μm (one shot at every 20 μm, a total of 11 shots), make measurements (n=10) and take an average value.

The percent open area is calculated from the following formula:

$$\text{Percent open area (\%)} = (\text{total of open area (mm}^2)/\text{Measured area (mm}^2)\times 100)$$

The total of open area can be calculated from (Total of open area at measurement/Enlargement magnification at measurement), and the measured area can be calculated from (Measured area at measurement/Enlargement magnification at measurement).

The fact that the fiber-to-fiber distance becomes greater and the surface of the fabric becomes rougher as the percent open area increases indicates that the fiber 101 is able to move, thus attaining a high degree of freedom. Furthermore, since the open area per unit area is high relative to nonwoven fabric having a greater fiber-to-fiber distance partially by means of opening processing or the like, the fiber-to-fiber distance increases in the whole surface to which fluid mainly composed of gas in the nonwoven fabric blows. Therefore, for example, in using the nonwoven fabric for an absorbable product, the resistance when a predetermined liquid, such as an excretory substance, passes through the nonwoven fabric 120 can be reduced, thus facilitating movement of the liquid into an absorber or the like.

The open area per unit area refers to a percentage of the total area without fiber to the number of spaces without fiber within a predetermined area. The open area can be calculated as follows:

$$\text{Open area (mm}^2/pc) = (\text{Total of open area (mm}^2)/\text{Number of open areas } (pc))$$

A difference between a percent open area measured from a face on the side where the convex portion 2 protrudes outward in the convex portion 2 and a percent open area measured from a face on the opposite side to the face on the side where the convex portion 2 protrudes is 5 to 100%, preferably 5 to 80%, more preferably, 15 to 40% as an example.

The percent open area measured from the face on the side where the convex portion 2 protrudes is 50 to 100%, preferably, 50 to 90%, further preferably, 50 to 80%.

Further, the open area per unit area measured from the face on the side where the convex portion 2 protrudes is greater than 3000 $\mu m^2$, preferably, 3000 to 30000 $m^2$ and more preferably 5000 to 20000 $\mu m^2$.

1.4. Basis Weight

The average basis weight of the whole nonwoven fabric 120 may be specifically 10 to 200 $g/m^2$, preferably 20 to 100 $g/m^2$ as an example. When the nonwoven fabric 120 is used, for example, in a surface sheet of an absorbable product, an average basis weight of less than 10 $g/m^2$ may cause the product to be easily broken during use. On the other hand, with an average basis weight of more than 200 $g/m^2$ it may be difficult to smoothly move any supplied liquid downward.

The convex portion 2 is adjusted so that the basis weight of the fiber 101 may be greater than that of the groove portion 1. The basis weight of the central portion 9 in the convex portion 2 is, 15 to 250 $g/m^2$, preferably, 20 to 120 $g/m^2$, as an example. If the basis weight of the central portion 9 is less than 15 $g/m^2$, the convex portion 9 is not only able to be crushed by the empty weight of liquid included in the convex portion 2 or an external pressure, but also liquid once absorbed may sometimes flow back when external pressure is applied. If a basis weight of the convex portion 2 is more than 250 $g/m^2$, liquid brought to the central portion 9 has difficulty in traveling downward, so that the liquid gathers on the central portion 9, thus sometimes causing a user to have a wet feeling.

Moreover, a basis weight of the side portion 8 in the convex portion 2 can be arbitrarily adjusted according to various conditions such as the quantity of fluid mainly composed of gas (for example, hot air) or tension applied to the nonwoven fabric. Specifically, a basis weight in the side portion 8 is 20 to 280 $g/m^2$, preferably, 25 to 150 $g/m^2$ as an example. The weight in the side portion 8 of less than 20 $g/m^2$ may cause the side portion 8 to be extended by line tension. When a weight in the side portion 8 is more than 280 $g/m^2$, liquid brought to the side portion 8 has difficulty in traveling downward, so that the liquid gathers on the side portion 8, which may give a wet feeling to a user.

An average basis weight of the groove portion 1 is adjusted so that an average basis weight of the fiber 101 may be less than the convex portion 2. The average basis weight of the groove portion 1 is adjusted so as to be less than an average basis weight of the whole nonwoven fabric 120. For example, the average basis weight of the bottom 11 of the groove portion 1 may be 3 to 150 $g/m^2$, preferably 5 to 80 $g/m^2$ as an example. When the average basis weight of the bottom 11 of the groove portion 1 is less than 3 g/m$^2$, the nonwoven fabric may be easily broken during use. When the average basis weight of the bottom 11 of the groove portion 1 is more than 150 g/m$^2$, liquid brought to the groove portion 1 has difficulty in traveling downward, so that the liquid gathers on the groove portion 1, which may give a wet feeling to a user.

Moreover, an average weight of the whole groove portion is adjusted so as to be less than an average weight of the whole convex portion 2. Specifically, the average weight of the whole groove portion 1 is 90% or less of the average weight of the convex portion 2, preferably, 3 to 90%, more preferably, 3 to 70%. When the average weight of the whole groove portion 1 is greater than 90% of the average weight of the convex portion 2, the resistance against the liquid dropped onto the groove portion 1 to move downward (the other side) of the nonwoven fabric 120 will become increase, so that liquid may overflow from the groove portion 1. When the basis weight of the bottom 11 of the groove portion 1 is less than 3% of the basis weight of the convex portion 2, for example, use of the nonwoven fabric 120 in a surface sheet of an absorbable product may result in absorbent product that has an easily damaged surface sheet.

A basis weight of the joining portion 4 is 5 to 200 g/m$^2$, preferably, 10 to 100 g/m$^2$ as an example. With the basis weight of the joining portion 4 of less than 5 g/m$^2$, the joining portion 4 as well may be crushed when the convex portion 2 is crushed by excessive external pressure. Where the basis weight of the jointing portion 4 is more than 200 g/m$^2$, the predetermined liquid dropped onto the groove portion 1 will accumulate in the region of the joining portion 4 and, if an excessive external pressure is applied to the nonwoven fabric 120, the fluid will make direct contact with the skin, thus a wet feeling may be result.

1.5. Others

When the nonwoven fabric of this embodiment is used, for example, to absorb or pass predetermined liquid, the groove portion 1 passes liquid and the convex 2 is sufficiently porous so as to have difficulty in retaining liquid. Furthermore, the open portion 3 formed in the groove portion permits solid to pass through in addition to liquid.

The groove portion 1, having a plurality of open portions 3, is suited to passing liquid and solid material. Moreover, the fiber 101 in the bottom 11 of the groove portion 1 is oriented in the cross direction. This can prevent liquid from flowing excessively in the longitudinal direction of the groove portion 1 and from spreading widely. In the groove portion 1, the fiber 101 is oriented (CD orientation) in the width direction of the groove portion 1 even with a low weight, thus increasing strength (CD strength) of the nonwoven fabric in the width direction.

The basis weight of the convex portion 2 is adjusted so as to be high. This increases the number of fibers and fusing points, thus maintaining a porous configuration.

In the convex portion 2, the side portion 8 where the basis weight and the fiber density are adjusted so as to be greater than the central portion 9 is formed so as to support the central portion 9 of the convex portion 2. That is, in the side portion 8, most of the fibers 101 are oriented in the longitudinal direction, so that the fiber-to-fiber distance decreases, thus increasing fiber density and rigidity. This enables the side portion 8 to maintain the whole convex portion 2, which can prevent the convex portion 2 from being crushed by external pressure or the like.

In the groove portion 1, the percent content of laterally oriented fiber per unit area is greater than that in the central portion 9. In the side portion 8, the percent content of longitudinally oriented fiber per unit area is greater than that in the central portion 9. The central portion 9 includes more fiber 101 oriented in the thickness direction compared to that of the groove portion 1 or the side portion 8. Even if the thickness of the convex portion 2 is reduced, for example, by a load in the thickness direction applied to the central portion 9, the fiber 101 is able to return to its original height by the rigidity of the fiber 101 oriented in the thickness direction when the load is released. In other words, the fiber may be a nonwoven fabric with high compression recoverability.

1.6. Manufacturing Method

FIGS. 6 to 11, explain a manufacturing method for the nonwoven fabric 120 according to this embodiment will now be described. First, the fiber web 100 is placed on top of the supporting member 220 as a permeable supporting member. In other words, the fiber web 100 is supported from the bottom side by the supporting member 220.

By moving the supporting member 220, maintained in such a state that the fiber web 100 is supported in a predetermined direction and continuously blown with gas from the top side of the traveling fiber web 100, the nonwoven fabric 120 according to this embodiment can be produced.

As shown in FIGS. 6 and 7, a nonwoven fabric manufacturing apparatus 90 for manufacturing the nonwoven fabric 120 according to this embodiment is composed of: a permeable supporting member 200 for supporting the fiber web 100, as a fiber assembly, from below (a second side); a blowing section 910 as a blowing means for blowing fluid, mainly composed of gas, from above (a first side) in the fiber web 100 as the fiber assembly and an gas supply section (not shown); and a conveyer 930 as a conveying means for conveying the fiber 100 as a fiber assembly in a predetermined direction F.

The permeable supporting member 200 is composed of two components: a permeable portion and an impermeable portion. The permeable portion can ventilate fluid, mainly composed of gas, blown from the top side of the fiber web 100 to a lower side on the opposite side to the side where the fiber web 100 in the permeable supporting member 200 is disposed. The impermeable portion can inhibit the fluid, mainly composed of gas, blown from the top side of the fiber web 100 from being vented to the lower side in the permeable supporting member 200 and fiber 101 constituting the fiber web 100 from moving to the opposite side in the permeable supporting member 200.

As examples of the permeable supporting member 200 used in this embodiment, there are a member formed by disposing an impermeable portion at a predetermined mesh member in a predetermined patterning manner as shown in FIG. 3, and a member formed with a plurality of predetermined holes in an impermeable plate-shaped member as shown in FIG. 10.

As a member formed with an impermeable portion disposed at the predetermined mesh member in a predetermined patterning manner, for example, there is the supporting member 220 (FIG. 3) formed by arranging slender members 225 as impermeable portions in parallel at uniform intervals on one surface of the mesh supporting member 210 shown in FIG. 4. Following are examples of other embodiments where a shape or layout of each of the slender members 225 as impermeable portions is changed as necessary. The impermeable portion may be formed by filling the mesh open portions constituting a permeable portion, for example, with solder, resin or the like, in addition to a formation process by arranging the slender members 225 on one surface of the mesh supporting member 210 as shown in FIG. 3.

As a member formed with a plurality of predetermined holes in the impermeable plate-shaped member, for example, there is a plate-shaped supporting member 230 formed with a plurality of oval holes 233 constituting a permeable portion as shown in FIG. 10. Following are examples of other embodiments where the shape, size or layout of each of the holes 233 is adjusted as necessary. For example, there are other embodiments exemplified by adjusting the shape or the like of a plate portion 235 as an impermeable portion if necessary.

A ventilation degree in an area as a permeable portion is, for example, 10,000 to 60,000 cc/cm$^2$·min, preferably, 20,000 to 50,000 cc/cm$^2$·min as an example. However, a ventilation degree greater than a value described above may sometimes occurs in such a case where a permeable portion is formed, for example, by cutting out a metal plate or the like because the resistance of fluid, mainly composed of gas, to the plate portion becomes lost.

The nonwoven fabric 120 is formed while the fiber web 100 is being moved in a prescribed direction by the nonwoven manufacturing apparatus 90. The moving means moves the fiber web 100 as a fiber assembly in a state supported from one side by the permeable supporting member 200 in a predetermined direction. Specifically, the fiber web 100 in such a state that fluid, mainly composed of gas, is blown and the fiber web 100 is moved in the predetermined direction F. As the moving means, there is an example of the conveyer 930 as shown in FIG. 6. The conveyer 930 is composed of: a permeable belt section 939 and rotating sections 931 and 933. The permeable belt section 939, placed with the permeable supporting member 200, is formed in a laterally elongated ring shape. The rotating sections are disposed inside the permeable belt section 939 formed into a laterally elongated ring shape and on both ends in the longitudinal direction thereof and rotate the ring-shaped permeable belt section 939 in a prescribed direction.

The conveyer 930 conveys the permeable supporting member 200 in a predetermined direction F, in such a state that the fiber web 100 is supported from the bottom side. Specifically, as shown in FIG. 6, the fiber web 100 is moved so that it may pass under the blowing section 910. Furthermore, the fiber web 100 is moved so as to pass through the inside of a heater section 950 having both side faces open as heating means.

As shown in FIG. 8, the blowing means are provided with a gas supply section (not shown) and a blowing section 910. The gas supply section (not shown) is coupled to the blowing section 910 through a gas supply pipe 920. The gas supply pipe 920 is connected to the top of the blowing section 910. As shown in FIG. 9, the blowing section 910 is formed with a plurality of nozzle holes 913 arranged at predetermined intervals.

The gas fed to the blowing section 910 from the gas supply section (not shown) through the gas supply pipe 920 is blown from the plurality of nozzle holes 913 formed in the blowing section 910. The gas blown from the plurality of nozzle holes 913 is continuously blown onto the top side of the fiber web 100 supported on the permeable supporting member 200 from the bottom side thereof. Specifically, the gas blown from the plurality of nozzle holes 913 is continuously blown onto the top side of the fiber web 100 kept in such a state that it is conveyed in a predetermined direction F by the conveyer 930.

A suction section 915, which is disposed under the blowing section 910 and under the permeable supporting member 200, evacuates gas or the like blown from the blowing section 910 and passing through the permeable supporting member 200. Utilization of the suction by the sucking portion 915 may enable the fiber web 100 to be positioned so as to be attached onto the permeable supporting member 200. Furthermore, the use of the suction may also convey gas into the heater section 950 in such a state that the shape of a groove portion (roughness) or the like formed by air flow is well kept. Moreover, the sucking section 915 evacuates the blown fluid, mainly composed of gas, which can prevent the shape of the fiber web 100 from being disturbed by the fluid, mainly composed of gas, when the fluid is excessively rebounded upon hitting the permeable supporting member 200.

It is sufficient if the suction pressure by the sucking section 915 is to such a degree that the fiber 101 in an area to which fluid, mainly composed of gas, is blown is pressed against the permeable supporting member 200.

By adjusting an air flow or temperature of fluid, mainly composed of gas, to be blown, a lead-in amount, ventilation of the supporting member or the basis weight of the fiber web 100, the shape of the convex portion 2, the open portion 3 or the joining portion 4 can be modified. For example, when the amount of blown fluid, mainly composed of gas, is almost equal to or less than that of the evacuated fluid, mainly composed of gas, the rear side of the convex portion 2 in the nonwoven fabric 120 is formed so as to fit to the shape of the permeable supporting member 200. Therefore, when a shape of the permeable supporting member is flat, the rear side of the convex portion in the nonwoven fabric 120 is substantially flat.

Moreover, when fluid, mainly composed of gas, is drawn in from beneath the permeable supporting member 200, fiber in an area where fluid, mainly composed of gas, is blown is moved while being pressed against the permeable supporting member 200, so that fiber accumulates on the supporting member side. In the convex portion 2, the blown fluid, mainly composed of gas, collides with the permeable supporting member 200 and is rebounded appropriately, so that fiber is kept in such a state as to partially face the thickness direction.

The temperature of fluid, mainly composed of gas, blown from each of the nozzle holes 913 may be at room temperature, however, for example, for satisfactory formation of the groove portions, the temperature can be controlled so as to be at least at a softening point of thermoplastic fiber constituting a fiber assembly, preferably, a temperature range of from +50° C. to −50° C. of the melting point. When fiber is softened, the repulsion of the fiber itself lowers, so that the fiber is able to retain a rearranged shape by airflow or the like. When the temperature is increased further, heat fusion starts between fibers, so that the shape of a groove portion or the like is easier to retain. This can facilitate conveyance into the heater section 950 with retaining the shape of the groove portion (concavity and convexity) or the like.

The heater section 950 as a heating means has both ends open in the predetermined direction F. This allows the fiber web 100 (a nonwoven fabric 120) placed on the permeable supporting member 200 conveyed by the conveyer 930 to be continuously conveyed with a heating space formed inside the heater section 950 retained for a predetermined time. For example, by including thermoplastic fiber in the fiber 101 constituting the fiber web 100 (nonwoven fabric 120), the nonwoven fabric 115 formed by bonding the fibers 101 to each other by means of heating with the heater section 950 can be attained.

The permeable supporting member 200 is replaceable as necessary in producing nonwoven fabric. Specifically, in producing the nonwoven fabric 120 according to this embodiment, the supporting member 220 may be used as the permeable supporting member 200.

When the supporting member 220 as shown in FIG. 3 is used in producing the nonwoven fabric 120 according to this embodiment, the supporting member 220 with the fiber web 100 placed on the top side thereof is conveyed in such a direction as to be substantially orthogonal to the longitudinal direction of the slender member 225. This allows gas to be continuously blown onto the top side of the fiber web 100 in a direction substantially orthogonal to the slender member 225. That is, the groove portion 1 is formed in such a direction as to be roughly orthogonal to the slender member 225. The open portion 3 described later is formed at a position where the slender member 225 and the groove portion 1 cross each other.

As described above, the slender member 225 is an impermeable member and will not ventilate the gas blown from above, for example. In other words, the gas blown onto the slender member 225 changes its flowing direction.

The slender member 225 will not move the fiber 101 in the fiber web 100 to downside of the supporting member 220

Movement of the fiber 101 constituting the fiber web 100 is achieved by the gas which is to be blown and/or has been blown from above the fiber web 100 and ventilates the fiber web 100 and of which the flowing direction has been modified by the slender members 225.

For example, the fiber 101 in an area (a first area) where gas is blown is moved to an area (a second area) adjacent to the first area. The first area where gas is blown moves in a predetermined direction, so that the fiber is moved to a lateral area continuously in the predetermined direction where the gas has blown.

This process forms the groove portions 1 and the fiber 101 of the bottom 11 in each of the groove portions 1 is moved so as to be oriented in a width direction. Moreover, the convex portion 2 is formed between the groove portions 1 and the fiber density of the lateral portion in the convex portion 2 increases, so that the fiber 101 is oriented in the longitudinal direction.

In addition, the gas which has been blown, ventilates the fiber web 100 and of which flow direction has been modified by the slender members 225, moves the fiber 101 constituting the fiber web 101 in a different direction from that of above.

The mesh supporting member 210 constituting the supporting member 220 and the slender members 225 control movement of the fiber 101 to downside of the supporting member 220, so that the fiber 101 is moved in such a direction along the top of the supporting member 220.

Specifically, the gas blown onto the slender members 225 is redirected to such a direction along the slender members 225. The gas which has been redirected moves the fiber 101 disposed on the tops of the mesh members 225 to a surrounding area from the tops of the slender members 225. This process forms the open portion 3 of a predetermined shape. At least one of orientation, fiber density or basis weight of the fiber 101 is adjusted.

To form the nonwoven fabric 120 with the open portion 3, a supporting member different from the supporting member 220 described above may be used. The size or arrangement of the like of the groove portion 1, the convex portion 2, the open portion 3 and joining portion 4 may be changed with the supporting member. For example, the supporting member 270 as shown in FIG. 11 may be used.

The supporting member 270 is a spiral-woven permeable net formed by alternately winding another wire 272 of a predetermined thickness alternately in a spiral manner so as to bridge a plurality of wires 271 to each other relative to a wire 271 of a predetermined thickness arranged in a substantially parallel format.

The wire 271 and the wire 272 in the supporting member 270 are impermeable. An area surrounded by the wire 271 and the wire 272 of the supporting member 270 becomes the hole portion 273 as a permeable portion.

In this type of supporting member, a weave, or a thickness or shape of yarn may be partially changed to make a partial change in a ventilation degree. The supporting member 270 may be used, for example, by spirally weaving the wire 271 and the wire 272 formed into a circular shape of stainless steel and a flat shape of stainless steel, respectively.

The ventilation degrees of the wires 271 and 272 (especially, intersection points of wires) as impermeable portions in such a case are 90% or less of that of the hole portion 273 as an permeable portion, preferably, 0 to 50%, more preferably, 0 to 20% as an example. 0% used herein means that fluid, mainly composed of gas, has substantially no ventilation.

In the case of use of the supporting member 270, for example, when fluid, mainly composed of gas, is blown onto intersection portions between the wires 271 and 272 in the supporting member 270, the fluid, mainly composed of gas, turns its flowing direction by the intersection portions. This allows the fiber 101 supported at the intersection portions to be drawn to move right/left and forward/backward by the blowing fluid, thus forming the open portions 3.

In the area which has been supported at any position except the intersection portion at the groove portion 1 or the area on the top of the hole portion 273, while downward movement thereof is being controlled, the longitudinally oriented fiber is moved to the side portion 8 in the convex portion 2. Moreover, the laterally oriented fiber is moved from the open portions formed by the intersection portions of the supporting member 270 to form the joining portion 4.

Moreover, the temperature, amount or pressure of the fluid blown over the fiber web 100 and mainly composed of gas is adjusted in addition to adjustment of the traveling speed of the fiber web 100 by a conveyance apparatus and tension adjustment. This enables manufacture of a nonwoven fabric having the same mode, weight or fiber density of the open portion 3, the groove portion 1 or the convex portion 2 even on a different supporting member.

2. Other Embodiments

Other embodiments of a nonwoven fabric according to the present invention will be described below. Unless otherwise described, the following embodiments are the same as the first embodiment. The numbers appended on drawings are also the same as those in the first embodiment if the numbers have the same meanings.

FIGS. 12 to 19, explain second to sixth embodiments of nonwoven fabric according to the present invention. The second embodiment is an embodiment showing that a face formed with a convex portion is different from a face on the opposite side. The third embodiment is an embodiment having a different shape of the whole nonwoven fabric. The fourth embodiment is an embodiment having different convex portions in nonwoven fabric. The fifth embodiment is an embodiment having different groove portions. The sixth embodiment is an embodiment having different open portions.

2.1. Second Embodiment

FIG. 12 explains a second embodiment of nonwoven fabric according to the present invention.

As shown in FIG. 12, the nonwoven fabric 172 according to this embodiment has a face on the opposite side to a face formed with groove portions 1 and the convex portions 2, which is different from the one described in the first embodiment. The present invention will be described below with high priority placed on points different from those described in the first embodiment.

2.1.1. Nonwoven Fabric

The nonwoven fabric 172 according to this embodiment has the groove portions 1 and the convex portions 2 formed in parallel alternately on one side. On the other side of the nonwoven fabric 172, an area corresponding to the bottom of the convex portion 2 is formed so as to protrude to the side where the convex portion 2 protrudes. In other words, the nonwoven fabric 172 is recessed with an area corresponding to the bottom of the convex portion 2 on one side recessed. In addition, an area on the other side corresponding to the bottom of the groove portion 1 on one side protrudes in the opposite direction to the convex portion 2 on one side to form a convex portion.

2.1.2. Manufacturing Method

In addition to the above, the manufacturing method for the nonwoven fabric 172 according to this embodiment is as described in the first embodiment above. A supporting member used for manufacturing the nonwoven fabric 172 may use the supporting member 220 or the supporting member 270 in the first embodiment described above.

The nonwoven fabric 172 is blown with a fluid, mainly composed of gas, under such a state that a fiber assembly is supported by the supporting member 220 or the supporting member 270 from the bottom side thereof and evacuates the fluid, mainly composed of gas, blown from downward of the supporting member 220 or the supporting member 270. The amount of fluid, mainly composed of gas, to be evacuated is less than the amount fluid, mainly composed of gas, to be blown and, if the fluid, mainly composed of gas, to be blown is greater than the amount of the fluid, mainly composed of gas to be evacuated, the fluid mainly composed of gas to be blown is slightly rebounded, thus forming the bottom side of the convex portion 2 so as to protrude in the same direction as the convex portion 2 on the top side of the convex portion 2. As a result, an area on the other side corresponding to the bottom of the groove portion 1 relatively protrudes and a convex portion projecting from the bottom side is formed.

2.2. Third Embodiment

FIGS. 13 and 14, explain a third embodiment of the nonwoven fabric according to the present invention.

2.2.1. Nonwoven Fabric

As shown in FIG. 13, the nonwoven fabric 174 in this embodiment is different from that in the first embodiment in that the whole of the nonwoven fabric 174 undulates in a wavelike manner. The present invention will be described below with high priority placed on points different from those in the first embodiment.

The nonwoven fabric 174 in this embodiment is formed having wavelike undulations so that the whole of the nonwoven fabric 174 may be roughly orthogonal to such a direction that the groove portion 1 and the convex portion 2 extend.

2.2.2. Manufacturing Method

The method for manufacturing the nonwoven fabric 174 in this embodiment is the same as in the first embodiment, however, is different in a mode of the supporting member 280 as a permeable supporting member. The supporting member 280 in this embodiment is a supporting member formed by disposing a plurality of slender members 285 on the top of the net supporting member 260 almost in parallel at predetermined intervals, as described in FIG. 14.

The supporting member 280 in this embodiment is a supporting member having wavelike undulations in parallel, in either of longer or shorter direction of the supporting member 280 as shown in FIG. 14. Each of the mesh supporting members 260 constituting the supporting member 280 is formed with a plurality of small-diameter holes as described, and the gas blown from the top side of the fiber web 100 is ventilated downward without being affected by the mesh supporting member 260. The mesh supporting member 260 does not largely change the flow of fluid, mainly composed of gas, to be blown or does not move the fiber 101 in a downward direction of the mesh supporting member 260.

In addition, the slender member 285 disposed on the top of the mesh supporting member 260 constituting the supporting member 280 is an impermeable portion that does not ventilate fluid, mainly composed of gas, to be blown from the top to downward. The slender member changes a flowing direction of fluid, mainly composed of gas, blown from the top. As a result, fluid, mainly composed of gas, blown onto the slender member 285 and/of fluid, mainly composed of gas, blown onto the slender member 285 to modify its flowing direction, moves the fiber 101 to form the open portion 3.

Furthermore, the mesh supporting member 260 itself constituting the supporting member 280 has undulations, therefore fluid, mainly composed of gas, blown from the top of fiber web 100 permits the fiber web 100 to be formed into such a shape as to have undulations along the shape of the supporting member 280.

In this embodiment, the fiber web 100 is moved along an X-axis direction while fluid, mainly composed of gas, is being blown onto the fiber webs 100 placed on the top of the supporting member 280, thus forming the nonwoven fabric 174 according to this embodiment.

An embodiment of undulations in the supporting member 280 can be defined arbitrarily. For example, pitches between tops of undulations in the X-axis direction as defined in FIG. 14 are 1 to 30 mm, preferably, 3 to 10 mm, as an example. Moreover, the differences in the height between the tops and bottoms of the undulations in the supporting member 280 are, for example, 0.5 to 20 mm, preferably, 3 to 10 mm, as an example. Furthermore, the shape of the supporting member 280 in the X direction is not limited to a waveform as shown in FIG. 14. There are examples of a shape having continuous rough triangles shapes so that respective tops of undulations may form an acute angle and a shape having continuous substantially square shape irregularities so that respective tops of undulations may be roughly flat.

The nonwoven fabric 174 in this embodiment can be manufactured with the nonwoven manufacturing apparatus 90 described above. The manufacturing method for the nonwoven fabric 174 with the nonwoven manufacturing apparatus 90 and so on may refer to descriptions in the manufacturing method for the nonwoven fabric 120 according to the first embodiment and details of the nonwoven fabric manufacturing apparatus 90.

2.3. Fourth Embodiment

FIG. 15 explains a fourth embodiment of nonwoven fabric according to the present invention.

As shown in FIG. 15, nonwoven fiber 176 according to this embodiment is different from the first embodiment in that it has second convex portions 22 which are thinner than the convex portions 2. The fourth embodiment will be described below with high priority placed on points different from those in the first embodiment.

2.3.1 Nonwoven Fabric

A plurality of groove portions 1 are formed in parallel to each other on one side of the nonwoven fiber 176. A plurality of convex portions 2 and a plurality of convex portions 22 are alternately positioned between a plurality of groove portions 1, respectively. The convex portions 2 and the second convex portions are formed in parallel to each other in the same way as for the groove portions 1. Moreover, there are formed open portions 3 and joining portions 4 in a groove portion 1.

The convex portions 2 and the second convex portions 22 are areas in a fiber web 100 onto which fluid, mainly composed of gas, is not blown and areas which are relatively projected by formation of the groove portions 1. The second convex portions 22 are smaller than the convex portions 2 both in thickness and width directions of the nonwoven fabric 176, while the fiber density, orientation and basis weight of the second convex portions 22 are the same as those of the convex portion 2.

Between the plurality of parallel-formed grooves 1, there is formed the convex portion 2 or the second convex portion 22 respectively in the nonwoven fiber 176. The convex portion 2 and the second convex portion 22 are positioned adjacent to each other, sandwiching the groove portion 1. In other words, the plurality of convex portions 2 and the plurality of second convex portions 22 are formed alternately, sandwiching the groove portions 1, respectively. Specifically, an arrangement pattern of the convex portion 2, the groove portion 1, the second convex portion 22, the groove portion 1 and the convex portion 2 are repeated in a sequential order. The positional relationship between the convex portions 2 and the second convex portions 22 is not limited to the one described above. For example, part of the nonwoven fiber 176 may be formed so that the plurality of convex portions 2 are adjacent to each other sandwiching the groove portion 1. On the other hand, the plurality of second convex portions 22 may be positioned adjacent to each other sandwiching the groove portion 1.

2.3.2. Manufacturing Method

In a manufacturing method for the nonwoven fabric according to the fourth embodiment, a mode of nozzle holes 913 of a nonwoven fabric manufacturing apparatus is different from the one of the nozzle holes for the first embodiment.

For example, the nonwoven fiber 176 may be manufactured by a nonwoven fiber manufacturing apparatus 90 provided with adjustment of a distance between the nozzle holes 913 for blowing fluid, mainly composed of gas. For instance, by setting the distance between the nozzle holes 913 to be less than that described in the first embodiment, a second convex portion 22 which is thinner than the convex portion 2 may be formed. On the other hand, by setting the distance between the nozzle holes 913 to be greater than that described in the first embodiment, a second convex portion greater in width than the convex portion 2 may be formed. Furthermore, by setting the distance between the nozzle holes so as to be alternately narrow and wide, the nonwoven fiber 176 may be manufactured with the convex portions 2 and the second convex portions 22 alternately positioned in parallel to each other, sandwiching the groove portions 1.

The nonwoven fiber 176 according to the fourth embodiment can be manufactured with the nonwoven fiber manufacturing apparatus 90 as mentioned above. Other items in manufacturing the nonwoven fiber 176 with the manufacturing apparatus 90 may refer to descriptions in the manufacturing method for the nonwoven fiber 120 according to the first embodiment and details of the nonwoven fiber manufacturing apparatus 90.

2.4. Fifth Embodiment

FIGS. 16 and 18, explain a fifth embodiment of the nonwoven fabric according to the present invention. The fifth embodiment according to the present invention is different from the first embodiment in that joining portions 4 recessed in the thickness direction. The fifth embodiment will be described below with high priority placed on points different from those in the first embodiment.

2.4.1. Nonwoven Fabric

As shown in FIGS. 16 to 18, nonwoven fiber 178 according to the fifth embodiment is formed with groove portions 1 and convex portions 2 on one side thereof. The groove portion 1 is formed with a plurality of open portions 3 at predetermined intervals.

Between open portion 3 and neighboring open portions 3 thereof in the groove portion 1, there are formed a plurality of recessed portions 44 recessed in the nonwoven fiber 178 in the thickness direction. The bottom of each of the recessed portions 44 is lower than the groove portion 1 in thickness direction.

The percentage content of laterally oriented fiber is greater than that of longitudinally oriented fiber at the bottom of the recessed portion 44. In short, the fiber constituting the bottom of the recessed portion 44 is formed so as to be oriented roughly orthogonally (laterally) to such a direction that the groove portion 1 mainly extends.

The open portion 3 is formed at a projecting portion 40 provided so that an area except the recessed portion 44 in the groove portion 1 is protruded as the recessed portion 44 is recessed in the thickness direction of the nonwoven fiber 178.

The fiber 101 of the projecting portion 40 at a peripheral edge of the open portion 3 is oriented along the peripheral edge of the open portion 3. This is because the fiber 101 is moved along the peripheral edge of the open portion 3 by the blown fluid, mainly composed of gas, and/or the one of which flow direction is modified as the fluid is blown onto a plate portion 295 of a plate-shaped supporting member 290.

The sizes and other characteristics of the recessed portion 44 and the projecting portion 40 in the groove portion 1 can be set as necessary. The longitudinal pitch between the projecting portion 40 and the adjacent projecting portion 40 thereto is 1 to 30 mm, preferably 3 to 10 mm as an example. A height difference between the recessed portion 44 and the projecting portion 40 is 0.5 to 20 mm, preferably 3 to 10 mm, as an example.

An average basis weight of the joining portion 40 is 5 to 200 g/m$^2$, preferably 10 to 100 g/m$^2$ as an example. An average fiber density of the projecting portion 40 is 0.20 g/cm$^3$ or less, preferably 0.005 to 0.05 g/cm$^3$, more preferably 0.007 to 0.10 g/cm$^3$, as an example.

If the average basis weight of the projecting portion 40 is less than 5 g/m$^2$ or that the average fiber density is less than 0.005 g/cm$^3$, when an excessive external pressure is applied so that the convex portion 2 is crushed and hence the projecting portion 40 is also crushed, this may cause a space formed by the recessed portion 44 not to be retained.

On the other hand, if the average basis weight of the projecting portion 40 is greater than 0.20 g/cm$^2$ or the average fiber density thereof is greater than 0.20 g/cm$^3$, the predetermined liquid dropped onto the groove portion 1 will accumulate on the projecting portion 40 and, if an excessive external pressure is applied to the nonwoven fabric 178 and the fluid comes into direct contact with the skin, a wet feeling may occur.

A basis weight of the joining portion 44 is 0 to 100 g/m$^2$, preferably 0 to 50 g/m$^2$ as an example. A fiber density of the recessed portion 44 is 0.20 g/cm$^3$ or less, preferably 0.0 to 0.10 g/cm$^3$.

If the basis weight of the recessed portion 44 is greater than 100 g/m$^2$ or the fiber density thereof is greater than 0.20 g/cm$^3$, the predetermined liquid that drops onto the groove portion 1 will temporarily accumulate in the recessed portion 44. When this nonwoven fiber 178 is used as a surface sheet of absorbable products or the like, it is possible that the liquid may easily overflow from the hollowed portion 44, spread to the groove portion 1 and further to the surface of the nonwoven fiber 178, and eventually may soil the skin, if a wearer moves under the condition that the liquid builds up in the hollowed portion 44.

2.4.2. Manufacturing Method and Supporting Member

The manufacturing method for the nonwoven fabric 178 of the present invention is the same as the above, however, it is different in regards to the permeable supporting member.

The nonwoven fabric 178 can be manufactured by moving fluid, mainly composed of gas, in the Z-direction while blowing the fluid at a greater pressure than the pressure of the blowing fluid, mainly composed of gas, as described in the first embodiment, onto a fiber web 1 placed on the top of a plate-shaped supporting member 290 from the top side of the fiber web 100.

A plate portion 295 will not let the blown fluid, mainly composed of gas, to move downward. The fluid, mainly composed of gas, blown onto the fiber web 100 placed on the top of the plate portion 295 modifies the flow direction of the fluid. For example, when the fluid, mainly composed of gas, is blown, the groove portion 1 is formed. At this time, the fluid which is blown onto the plate portion 295 of the plate-shaped supporting member 290 modifies the flow direction of the fluid and is not ventilated downwards.

Then, the blown fluid, mainly composed of gas, and/or the fluid, mainly composed of gas, which has changed its flow direction after having been blown onto the plate portion 295 moves the fiber 101 to a surrounding area thereof. Specifically, the longitudinally oriented fiber in the groove portion 1 is moved to the concave portion 2 side by the blowing force, while the laterally oriented fiber in the groove portion 1 is moved, by the blowing force, to back and forth in the direction along the longitudinal direction of the groove portion 1 to form the open portion.

As shown in FIG. 18, when fluid, mainly composed of gas, is blown onto the open portions 293 in the plate-shaped supporting member 290, fiber is deformed along the inside surface of the open portions 293 to form the recessed portion 44.

In the recessed portion 44, the longitudinally oriented fiber in the recessed portion 44 is moved to the convex portion 2 side by blowing, so that the laterally oriented fiber is left in the recessed portion 44. Accordingly, the recessed portion 44 is wholly oriented in the direction roughly orthogonal to the groove portion 1.

Moreover, for example, the mesh supporting member 210 or the like may be provided under the plate-shaped supporting member 290. Provision of the mesh supporting member 210 can nearly level the side facing the supporting member in the recessed portion 44.

Moreover, by changing the thickness of the plate-shaped supporting member 290 or the amount or pressure of fluid, mainly composed of gas, the nonwoven-fabric 120 in the first embodiment can be formed. Furthermore, the nonwoven-fabric in which the recessed portion 44 is protruded in a projecting manner (Ω-shape) from the open portion 293 to downward of the plate-shaped supporting member 290. Formation of the nonwoven-fabric in which the recessed portion 44 is protruded in a projecting manner to downward of the plate-shaped supporting member 290 may become necessary, for example, in any of the following cases: a case where fluid, mainly comprised of gas, is strongly blown, a case where the amount of the blown fluid, mainly comprised of gas, is large, a case where a line tension is not almost applied to the fiber web 100, or a case where the fiber web 100 is placed almost in an overfeed state immediately before the fluid, mainly composed of gas. In such a case, the fiber 101 is able to enter the open portion 293.

The plate-shaped supporting member 290 according to the fifth embodiment, as shown in FIG. 17, is a plate-shaped member formed with the plurality of open portions 293. Specifically, the plate-shaped supporting member 290 is formed out of the plate portion 295 as an impermeable portion and the open portions 293 as permeable portions.

The plate-shaped supporting member 290 has a predetermined thickness appropriate enough for the fiber 101 in the groove portion 1 to enter the open portions 293, thus forming the recessed portion 44 and providing a space downward of the projecting portion 40. This enables a predetermined amount of high-viscosity liquid to be stored in the space, for example, when the high-viscosity liquid is brought to the nonwoven-fabric 178.

In forming the nonwoven fabric 178 according to the fifth embodiment, the thickness of the plate-shaped supporting member 290 is 0.5 to 20 mm, preferably 1.0 to 5.0 mm, as an example. Moreover, in forming the nonwoven-fabric 120 according to the first embodiment, the thickness of the plate-shaped supporting member 290 is 0.01 to 20 mm, preferably 0.1 to 5 mm, as an example. Furthermore, in forming the nonwoven-fabric in which the recessed portion 44 is protruded in a projecting manner to downward of the plate-shaped supporting member 290, the thickness of the plate-shaped supporting member 290 is 0.5 to 20 mm, preferably 1.0 to 10 mm, as an example. In addition, when the thickness of the plate-shaped supporting member 290 is 20 mm or more in every plate-shaped supporting member 290, low productivity may be caused because the fiber which enters the plurality of the open portions 293 in the plate-shaped supporting member 290 causes difficult separation.

2.5. Sixth Embodiment

FIG. 19, explains a sixth embodiment of nonwoven fabric according to the present invention.

As shown in FIG. 19, nonwoven fabric 160 according to the sixth embodiment is the nonwoven fabric which is formed with a plurality of open portions 3. The sixth embodiment is different from the first embodiment in that no convex portions or groove portions are formed. The sixth embodiment will be described below with high priority placed on points different from those in the first embodiment.

2.5.1. Nonwoven Fabric

As shown in FIG. 19, nonwoven fabric 160 according to the sixth embodiment is the nonwoven fabric which is formed with the plurality of open portions 3.

The open portions 3 are formed at substantially equal intervals along the longitudinal direction, for example, where fluid, mainly composed of gas, is blown onto the fiber web 100 as a fiber assembly. Moreover, the plurality of open portions 3 are formed at equal intervals in the width direction in the fiber web 100. The intervals in which the open portions 3 are formed are not limited to these. For example, the open portions may be formed for each different interval.

Each of the plurality of open portions 3 is formed into a substantially circular shape or substantially oval shape. Oriented fiber in each of the plurality of open portions 3 is oriented along the periphery of the open portion 3. In other words, an end portion of the open portion 3 in the longitudinal direction is oriented in such a direction as to cross the longitudinal direction, and a side portion of the open portion 3 in the longitudinal direction is oriented so as to run along the longitudinal direction.

Moreover, the fiber 101 around each of the plurality of open portions 3 is moved to the periphery of the open portions 3 by the fluid, mainly composed of gas, to be blown, therefore the fiber density of the periphery of the open portion 3 is adjusted so as to be greater than the fiber density in another area except around the open portion 3.

Moreover, the fiber density of the face (lower) on the side placed on the supporting member 220 (FIG. 3) is formed so as to be greater than the fiber density of the face (top) on the opposite side to the side where the fiber is placed on the supporting member in the thickness direction of the nonwoven fabric 160. This allows the fiber 101 having flexibility in the fiber web 100 to be gathered on the supporting member 220 side by the gravity or the blown fluid, mainly composed of gas.

2.5.2. Manufacturing Method

The manufacturing method according to the sixth embodiment is the same as for the first embodiment, however, is different in that the nonwoven fabric 160 is formed with no groove portions or convex portions. The different points will be described below on a priority basis.

Examples of a permeable supporting member for forming the nonwoven-fabric 160 as described in FIG. 19, there are proposed a supporting member 220 as described in FIG. 3, a plate-shaped supporting member 290 as described in FIG. 18, and a plate having no permeable portion.

In using the supporting member 220 and the plate-shaped supporting member 290, for example, the fiber web 100 is placed on the supporting member, the supporting member with the fiber web 100 supported is moved in a predetermined direction, the fluid, mainly composed of gas, is continuously blown to a degree that the groove portion is not formed from the top side of the fiber web 100 being moved.

Specifically, only the open portions are formed by the blown fluid, mainly composed of gas, and/or the blown fluid, mainly composed of gas, which ventilates the fiber web 100 and of which the flowing direction has been modified by the slender members 225.

It is sufficient if the amount of fluid, mainly composed of gas, to be blown onto the nonwoven fabric 160 is to such a degree that fiber 101 of the fiber web 100 in an area to which fluid, mainly composed of gas, is blown without forming the groove portion 1 can be moved. In this case, it is not necessary to evacuate the fluid, mainly composed of gas, to be blown, downward of the supporting member 220 with a sucking section 915. Evacuation may be performed from below the supporting member 220 so as not to cause disturbance of the shape of the formed fiber web 100 resulting from the blown fluid, mainly composed of gas, being rebounded by the supporting member 220. In performing evacuation of the fluid, preferably, the evacuated amount of the fluid, mainly composed of gas, is to a degree that the fiber web 100 is not pressed against the supporting member 220 or is not crushed.

In using a plate without permeable portion or the like, the fiber web 100 is placed on the plate and the fluid, mainly composed of gas, is intermittently blown while the supporting member with the fiber web 100 supported is being moved in a predetermined direction, thus manufacturing the nonwoven fabric. Since the plate is impermeable, the fluid, mainly composed of gas, blown intermittently forms the open portion 3 together with the fluid, mainly composed of gas, which has modified a flowing direction thereof. In other words, the open portion 3 is formed at a portion onto which the fluid, mainly composed of gas, is blown.

Moreover, undulations formed by blowing fluid, mainly composed of gas, to form nonwoven fabric with undulations may be crushed by winding it around a roll. The fluid, mainly composed of gas, may be blown in such a state that the fiber 101 is fused to some degree after the fiber web 100 is previously heated with an oven or the like.

3. Embodiments

3.1. First Embodiment

Fiber Constitution

Fiber has a sheath-core constitution composed of high-density polyethylene and polyethylene terephthalate, using cotton blending with fiber A coated with hydrophilic oil solution having an average fineness of 3.3 dtex and an average fiber length of 51 mm and fiber B different from the fiber A in that the fiber is coated with water-repellent oil solution. A blending ratio of the fiber A to the fiber B is 70:30. The basis weight employs a fiber assembly adjusted to 40 g/m$^2$.

Manufacturing Conditions

As shown in FIG. 9, a plurality of nozzle holes 913 are formed, which have a diameter of 1.0 mm respectively and a pitch of 6.0 mm. The shape of each of the nozzle holes 913 is a circle and is cylindrical in cross section. The width of a nozzle portion 910 is 500 mm. Hot air is blown in such conditions that the temperature is 105° C. and the quantity of air is 1,000 l/min.

A backing employs a stainless sleeve hollowed in a laterally elongated rectangle with rounded edges with a length of 2 mm and a width of 70 mm. The patterns on the sleeves hollowed as described above are arranged in a grid manner at intervals of 3 mm in the MD direction (longitudinal direction: the direction in which groove portions or convex portions extend) and 3 mm in the CD direction (width direction: the direction almost orthogonal to the direction in which groove portions or convex portions extend). The thickness of the sleeve is 0.5 mm.

The constitution of fiber as described above is opened by a card machine capable of being operated at a speed of 20 m/min to produce fiber webs and the fiber webs are cut to be 450 mm in width. The cut fiber webs are conveyed through a 20-mesh permeable net at a speed of 3 m/min. An air flow is blown with design of the nozzle portion 910 and the nozzle holes 913 as described above in such conditions that the temperature is 105° C. and the volume of air is 1200 l/min so as to draw (evacuate) air from beneath a permeable net with an evacuation volume less than the volume of hot air being blown. Afterwards, the cut fiber webs kept in the permeable net are conveyed into an oven conditioned to a temperature of 125° C. and hot air blown at a frequency of 10 Hz for about 30 seconds.

Results

Convex portions: a basis weight of 51 g/m$^2$, a length in thickness direction of 3.4 mm (top thickness of 2.3 mm), a fiber density of 0.03 g/cm$^3$, a width of each of convex portions of 4.6 mm, and a pitch of 6.7 mm.

Groove portions: a basis weight of 9 g/m$^2$, a length in thickness direction of 1.8 mm, a fiber density of 0.005 g/cm$^3$, a width of each of groove portions of 2.1 mm, and a pitch of 6.7 mm.

Joining portions: a basis weight of 18 g/m$^2$, a length in thickness direction of 1.8 mm, a fiber density 0.01 g/cm$^3$, a width of each of joining portions of 2.1 mm, a length of each of projecting portions of 1.5 mm, a pitch in MD direction of 5.0 mm, and a pitch in CD direction of 6.7 mm.

Open portions: a width of each of open portions of 2.1 mm, a length of each of open portions of 3.5 mm, a pitch in MD direction of 5.0 mm, and a pitch in CD direction of 6.7 mm Shape: Convex portions, groove portions, open portions and joining portions are respectively formed. The reverse sides of convex portions are swollen in the same direction as the convex portions in a shape which forms no rearmost face of the nonwoven fabric. In the groove portions, a plurality of joining portions and open portions are alternately formed along the direction to which the groove portions extend. Each of the open portions has an area of 5.2 mm$^2$ and the shape of a vertically-long rectangle with rounded edges.

3.2. Second Embodiment

Fiber Composition

The composition of fiber is the same as that of the first embodiment.

Manufacturing Conditions

An air flow is blown with design of the nozzle portion 910 and the nozzle holes 913 as described above in such conditions that the temperature is 105° C. and the volume of air is 1000 l/min. The fiber webs having the fiber constitution as described above are drawn (sucked) downward to the permeable net with an evacuation volume close to or slightly greater than the volume of the air to be blown.

Results

Groove portions: a basis weight of 49 g/m$^2$, a length in thickness direction of 3.5 mm, a fiber density of 0.02 g/cm$^3$, a width of each of groove portions of 4.7 mm, and a pitch of 6.5 mm.

Groove portions: a basis weight of 12 g/m$^2$, a length in thickness direction of 1.9 mm, a fiber density of 0.006 g/cm$^3$, a width of each of groove portions of 1.8 mm, and a pitch of 6.5 mm.

Joining portions: a basis weight of 23 g/m$^2$, a length in thickness direction of 1.9 mm, a fiber density 0.01 g/cm$^3$, a width of each of joining portions of 1.8 mm, a length of each of projecting portions of 1.5 mm, a pitch in MD direction of 5.0 mm, and a pitch in CD direction of 6.5 mm.

Open portions: a width of each of open portions of 1.8 mm, a length of each of open portions of 3.2 mm, a pitch in MD direction of 5.0 mm, and a pitch in CD direction of 6.5 mm.

Shape: Convex portions, groove portions, open portions and joining portions are respectively formed. The reverse sides of convex portions are substantially flat. In the groove portions, a plurality of joining portions and open portions are alternately formed along the direction to which the groove portions extend. Each of the open portions has an area of 4.2 mm$^2$ and the shape of a vertically-long rectangle with rounded edges.

4. Applications

Nonwoven fabric according to the present invention is applicable to sheets of absorbable products such as sanitary napkins, liners, and diapers. The convex portions may be placed on the skin surface side or the reverse surface side. In most cases, placement of the nonwoven fabric on the skin surface side provides a reduced contact area with skin, thus reducing the likelihood of giving a wet feeling by bodily fluid. Moreover, the nonwoven fabric can be used as middle sheets between the top sheets and absorbers of absorbable products. The reduced areas of contact with the top sheets or the absorbers prevent bodily fluid from leaching from the absorbers. Also the nonwoven fabric is employed in the side sheets of absorbable products, the external surfaces of diapers (outmost portions), the internal members of Hook-and-Loop fasters or the like. Other applications can be illustrated in various areas such as wipers for removing dust and dirt adhering to floors or bodies, masks, and breast pads.

4.1. Top Sheets of Absorbable Products

An application of nonwoven fabric according to an embodiment of the present invention is exemplified in the case that the surface sheets 301 and 302 of absorbable products employ the nonwoven fabric which has undulations and is formed with a plurality of open portions 3 and a joining portion having relatively lower fabric density than the convex portions 2 on a recessed portion as shown in FIGS. 20 and 21. Preferably, the nonwoven fabric is placed so that a face formed with the convex portions 2 may be on the skin side.

In using the nonwoven fabric as the surface sheets 301 and 302 of the absorbable products, the predetermined fluid voided is mainly fallen into groove portions. Provision of the open portions 3 enables even viscous liquid, including solids, to be transferred into the absorber and to inhibit the liquid from widely spreading over the surface.

The joining portion 4 has a lower fiber density relative to the convex portions 2, thus enabling the quick transfer of the fluid voided on the joining portion 4 into the absorber.

Most of the joining portion 4 is oriented in the width direction, thus causing high tensile strength. High tensile strength applied in the width direction during wearing of the absorbable product helps to prevent damage to the surface sheets 301 and 302.

The side portions 8 of the convex portions 2 have high-density fiber for high stiffness. The high percentage content of longitudinally oriented fiber provides high resistance to crushing and has high compression recoverability even if the convex portions 2 are crushed by an external force.

When the external force applied to the surface sheets 301 and 302 changes with balance, the area in contact with skin can be kept low, enabling to retain feeling. Even if the fluid absorbed in the absorber leaches out, it is difficult for the fluid to widely redeposit on the skin.

4.2. Middle Sheets of Absorbable Products

An application of nonwoven fabric according to the present invention can be exemplified in the case that the middle sheet 311 of an absorbable product employs the nonwoven fabric which has undulations and is formed with a plurality of open portions 3 and a joining portion 4 having relatively lower fabric density than the convex portions 2 on a recessed portion as shown in FIG. 22. Preferably, the nonwoven fabric is disposed so that a face formed with the convex portions 2 may be on the side of the top sheet 310 side.

A plurality of spaces can be provided between the top sheet 310 and the middle sheet 311 by placing the nonwoven fabric as the middle sheet 311 so that the surface formed with the convex portions 2 is on the side of the top sheet 310. Even if overabundant liquid is voided in a very short time, there are few impediments for passing through of the liquid by providing the open portions 3 in the middle sheet 311, thus enabling to quickly transfer the fluid into the absorber and preventing the fluid from moving back to the top sheet 310 and spreading over the surface.

Even if the liquid passing through the middle sheet 311 and absorbed in the absorber is leached, the low contact ratio between the middle sheet 311 and the top sheet 310 prevents the liquid from moving back to the top sheet and widely redepositing on the skin.

The central portions 9 on the convex portions of middle sheet 311 contain more fiber oriented in the thickness direction than the side portions 8 and the groove portions. The tops of the convex portions 2 contact with the top sheet 310 facilitate to absorb the fluid remaining in the top sheet 310. This prevents the fluid from remaining in the top sheet 310.

The spottiness on the top sheet 310 and low fluid persistence prevent liquid from widely adhering to the skin for a long time. The high percent content of longitudinally oriented fiber at the side portions 8 of the convex portions 2 on the middle sheet 311 enables to induce the fluid transferred from the top sheet 310 to the side sheets 8 in the longitudinal direction. This prevents the induction of leakage from absorbable products when the liquid expands in the width direction, thus enhancing the absorption efficiency of the absorber.

4.3. Top Sheets of Absorbable Products

An application of nonwoven fabric according to the present invention can be exemplified in the case that the middle sheet 321 of an absorbable product employs the nonwoven fabric which has undulations and is formed with a plurality of open portions 3 and a joining portion 4 having relatively higher fabric density than the convex portions 2 on a recessed portion as shown in FIG. 23. Preferably, the nonwoven fabric is placed so that a face formed with the convex portions 2 may be is outside the absorbable product.

The surface formed with the convex portions 2 on an outermost portion 321 is positioned outside the absorbable product, therefore, a good feeling can be achieved mainly when a hand touch occurs in using the absorbable product. The open portions 3 in the groove portions 1 provide superior air permeability 5. Components Components of the present invention will be described in detail below.

5.1. Nonwoven Fabrics 5.1.1. Fiber Assembly

A fiber assembly is a substantially sheet-like assembly that is composed of individual fibers having flexibility. In other words, the fiber assembly is an assembly that has fiber-to-fiber flexibility. The fiber-to-fiber flexibility used herein means such a state that a fiber web as a fiber assembly can move freely via fluid, mainly composed of gas. The fiber assembly may be produced by, for example, blowing out mixed fibers containing a plurality of fibers to form a fiber layer having a predetermined thickness. It may also be produced by, for example, blowing out a plurality of different fibers several times each to form a laminated fiber layer.

Some examples of the fiber assembly according to the present invention will be described below. A fiber web produced by the card method or a fiber web before mutually thermally fused fibers are solidified; A fiber web produced by the airlaid method or a fiber web before mutually thermally fused fibers are solidified; A fiber web before thermally fused fibers embossed by the point bond method are solidified; A fiber assembly before being spun and embossed by the spun bond method or a fiber assembly before thermally fused fabrics embossed are solidified; A fiber web produced by the needle punch method and half-entangled; A fiber web produced by the spun lace method and half-entangled; A fiber assembly spun by the melt blown method before mutually thermally fused fibers are solidified; and A fiber assembly before fibers are mutually solidified by solvent produced by the solvent gluing method.

A fiber web produced by the card method which uses relatively long fibers facilitates rearrangement of the fibers via aerial (gaseous) flows. This fiber web represents the one formed only by entanglement, having high fiber-to-fiber flexibility and with no thermal adhesion applied yet. In producing a nonwoven fabric with retaining the shape of a groove portion (undulations) or the like, which has already been formed via a plurality of aerial (gaseous) flows by that time, it is preferable to use the through-air method, in which thermoplastic fibers contained in the fiber assembly are heat-sealed by the oven treatment (heat treatment) using a predetermined heating device or the like.

5.1.2. Fibers

Each of fibers constituting a fiber assembly (e.g. fibers 101 constituting a fiber web 100 described in FIG. 1) is composed, for example, of thermoplastic resins such as low-density polyethylene, high-density polyethylene, straight chain polyethylene, polypropylene, polyethylene terephthalate, modified polypropylene, modified polyethylene terephthalate, nylon and poly amide. These fibers are composed of any single resin or compound resin.

The compound fiber shape represents, for example, a sheath-core type in which a melting point of its core component is higher than that of its sheath component, a biased core type of sheath-core type, and a side-by-side type in which the melting points of its right and left components differ. In addition, the compound fiber shape may contain a hollow type, an atypical flat, Y or C type, a solid crimp fiber including potential crimp and apparent crimp, and a split fiber that is split up by physical load such as water flows, heat and embossing.

In order to produce a three-dimensional crimp shape, the compound shape is allowed to contain predetermined apparent crimp fiber and potential crimp fiber. The three-dimensional crimp shape here means a spiral, zigzag or Ω-shaped fiber. Even though the fiber is proactively oriented in a level direction, part of the fiber is oriented in a thickness direction. Because of this, buckling strength of the fiber itself works in the thickness direction, thus its bulk hardly crushes even if an external pressure is applied. In addition, the spiral-shaped three-dimensional crimp among others has the property of returning to its original shape when an external pressure is released. Hence, even if its bulk somewhat crushes due to an excessive external pressure, it is more likely to return to its original thickness after the external pressure is removed.

The apparent crimp fiber is a general term for previously-crimped fibers including the ones formed by machine crimping, the biased core type of sheath-core type fibers, and the side-by-side type fibers. The potential crimp fibers have the property of being crimped by heat.

The machine crimping is capable of controlling continuous straight fiber after spinning by a difference in peripheral speed of the line speed and the application of heat and pressure. As the number of crimps per unit length is larger, enhances the buckling strength against an external pressure can be enhanced. Preferably, the number of crimps is, for example, 10 to 35 pcs/inch, more preferably 15 to 30 pcs/inch.

Fiber formed by thermal shrinkage is composed of two or more resins having different melting points. When heat is applied to the fiber, a three-dimensional crimp takes place in the fiber because its thermal shrinkage factor changes due to the difference in melting points. The resin structure of a fiber cross-section represents the biased core type of sheath-core type and the side-by-side type in which the melting points of its right and left components differ. Preferably, a range of the thermal shrinkage factor for the fiber is, for example, 5 to 90%, more preferably 10 to 80%.

The measuring method for the thermal shrinkage factor is as follows: (1) Produce a 200 g/m$^2$ web using 100% of the fiber to be measured; (2) Prepare for a specimen cut to a size of 250×250 mm; (3) Leave the specimen in an oven conditioned to 145° C. (418.15 K) untouched for 5 min; (4) Measure the length of the specimen after shrinkage; and (5) Calculate the thermal shrinkage factor from the difference in specimen lengths between before and after thermal shrinkage When the unwoven fabric is used for surface sheet, a preferable fineness of the fabric is, for example, in the range 1.1 to 8.8 dtex in view of ease of liquid penetration and texture.

When the unwoven fabric is used as a surface sheet, cellulosic hydrophilic fibers, for example, such as pulp, chemical pulp, rayon, acetate and natural cotton may be contained in the fiber aggregate so as to absorb a small quantity of menstrual blood, sweat or the like sitting on the top of wearer's skin. Because such absorbed liquid is hardly evacuated from the cellulosic fibers, it is preferable, for example, that the entire fiber aggregate contain the cellulosic fibers in the range of 0.1 to 5 percent by mass.

When the unwoven fabric is used for surface sheet, hydrophilic agent, water-repellent agent or the like, for example, may be kneaded into the above-mentioned hydrophobic synthetic fiber, or the hydrophobic synthetic fiber may be coated in hydrophilic agent, water-repellent agent or the like, in view of ease of liquid penetration and rewet-back. Otherwise, hydrophilicity may be provided to the hydrophobic synthetic fiber by the corona treatment or plasma treatment. Otherwise, the hydrophobic synthetic fiber may contain some water-repellent fiber. The water-repellent fiber used herein means the one to which the known water-repellent finish has been applied.

The hydrophobic synthetic fiber may contain, for example, inorganic feeler such as titanium oxide, barium sulfate and calcium carbonate so as to enhance their whitening. In the case of a sheath-core type compound fiber, the inorganic feeler may be included in its core component only or in both of its core and sheath components.

As described earlier, it is the fiber web formed by the card method using relatively long fibers that facilitates rearrangement of the fibers via air flows. In producing a nonwoven fabric with retaining the shape of a groove portion (undulation) or the like, which has already been formed via multiple aerial flows by that time, the through-air method in which the thermoplastic fiber are heat-sealed by the oven treatment (heat treatment) is preferably used. In the through-air method, it is preferable to use the sheath-core type or side-by-side type fibers because intersection points of each of the fibers are heat-sealed. In addition, the fiber web is preferably composed of the sheath-core type fiber where each of the sheaths is most surely heat-sealed. Specifically, the sheath-core type compound fiber consisting of polyethylene terephthalate and polyethylene, or the sheath-core type compound fiber consisting of polypropylene and polyethylene is preferably used. These fibers are used either alone or in combination with two or more types. Preferably, a length of the fiber is 20 to 100 mm, more preferably 35 to 65 mm.

5.2. Nonwoven Fabrics 5.2.1. Fluid Mainly Composed of Gas

Fluid mainly composed of gas in the present invention represents, for example, a gas conditioned to a room temperature or a predetermined temperature and aerosol in which the gas contains solid or liquid minute particles.

The gas represents, for example, air, nitrogen and the like. In addition, the gas contains liquid vapors such as water vapors.

An aerosol is a gas in which liquid or solid substances are dispersed. Some examples are as follow: Coloring ink; Softener such as silicon to enhance flexibility; Hydrophilic or water-repellent activator to prevent static charge and control wetting; Titanium oxide to enhance fluid energy; Inorganic feeler such as barium sulfate; Powder bond such as polyethylene to enhance unevenness maintainability in heat treatment as well as enhance fluid energy; Diphenhydramine hydrochloride for itch relief, Antihistamine agent such as isopropyl methyl phenol; Moisturizer; and Disinfectant-dispersed substance. The solid substances include a gel-like solid substance.

The temperature of the fluid mainly composed of gas may be conditioned as necessary. It may be conditioned according to the characteristics of fiber constituting a fiber assembly and the forms of unwoven fabric to be manufactured.

In order to, for example, optimally move the fiber constituting a fiber assembly, the temperature of the fluid mainly composed of gas is preferably be somewhat high because flexibility of the fiber constituting the fiber assembly is enhanced by such a somewhat high temperature. When the fiber assembly contains thermoplastic fiber, the temperature of the fluid, mainly composed of gas, should be conditioned to the one where these thermoplastic fibers are softened. This process makes it possible to realize a composition where the thermoplastic fiber, which are situated in an area where the fluid, mainly composed of gas, is blown out, are softened or melted and hardened again.

This permits the shape of nonwoven fabric to be maintained, for example, by blowing fluid, mainly composed of gas. In addition, when the fiber assembly is moved by a predetermined moving apparatus, for example, strength high enough to prevent the fiber assembly (nonwoven fabric) from being broken is applied.

The flow rate of the fluid, mainly composed of gas, may be conditioned as necessary. A typical example of the fiber assembly having fiber-to-fiber flexibility uses the fiber which is composed of mainly a sheath-core fiber element having a sheath made of high-density polyethylene and a core made of polyethylene terephthalate with a fiber length of 20 to 100 mm, preferably 35 to 65 mm and fineness of 1.1 to 8.8 dtex, preferably 2.2 to 5.6 dtex, and a fiber web 100 conditioned to 10 to 1000 g/m$^2$, preferably 15 to 100 g/m$^2$. The fiber length is 20 to 100 mm, preferably 35 to 65 mm for opening by the card method and 1 to 50 mm, preferably 3 to 20 mm for opening by the airlaid method. As a typical example, fluid mainly composed of gas is blown onto the fiber web 100 using hot air from a nozzle portion 910 (nozzle hole 913 with a diameter of 0.1 to 30 mm, preferably 0.3 to 10 mm, a pitch of 0.5 to 20 mm, preferably 3 to 10 mm and a shape of complete round, oval or rectangle) formed with a plurality of nozzle holes 913 shown in FIG. 8 or 9, conditioned to a temperature of 15 to 15 to 300° C. (288.15 to 573.15 K), preferably 100 to 200° C. (373.15 to 473.15 K) at an air volume of 3 to 50

(l/(min-hole), preferably 5 to 20 (1/(min-hole). An optimum example in the fiber assembly according to the present invention is, for example, a fiber assembly composed of a constituent fiber can change its position and orientation when fluid, mainly composed of gas, is blown under the above conditions. With such fiber and manufacturing conditions, for example, the nonwoven fabric shown in FIGS. 2 and 3 can be formed. The dimensions and basis weights of the groove portion 1 and the convex portion 2 can be obtained in the following range: In the groove portion 1, thickness is 0.05 to 10 mm, preferably 0.1 to 5 mm, width is 0.1 to 30 mm, preferably 0.5 to 5 mm and basis weight is 2 to 900 g/m$^2$, preferably 10 to 90 g/m$^2$. In the convex portion 2, thickness is 0.1 to 15 mm, preferably 0.5 to 10 mm, width is 0.5 to 30 mm, preferably 1.0 to 10 mm, and basis weight is 5 to 1000 g/m$^2$, preferably 10 to 100 g/m$^2$. In the groove portion 1, the open portions 3 are formed at predetermined intervals and the joining portions 4 are formed between the open portions 3. The dimensions and basis weights of the open portion 3 and the joining portion 4 can be obtained in the following range: In the joining portion 4, thickness is equivalent to or less than that of the convex 2, preferably 20 to 100%, more preferably 40 to 70%, width and length are 0.1 to 30 mm, preferably 0.5 to 10 mm and basis weight is 5 to 200 g/m$^2$, preferably 10 to 100 g/m$^2$. In the open portion 3, width and length are 0.1 to 30 mm, preferably 0.5 to 10 mm and basis weight is 0 to 100 g/m$^2$, preferably 10 to 100 g/m$^2$. The nonwoven fabric can be manufactured almost in the range of values described above, but not limited to the range.

5.2.2. Permeable Supporting Member

As a permeable supporting means 200, there is exemplified a supporting member in which the side of supporting the fiber web 100 is a roughly plane or curved shape and a roughly plane or curved surface is substantially flat. As the roughly plane or curved shape, a plate-shaped or cylindrical shape can be exemplified. The roughly flat shape means, for example, that the surface itself of the supporting member for placing the fiber web 100 is not formed into an undulating shape or the like. Specifically, there is exemplified a supporting member in which the mesh of a mesh supporting 210 has no undulating shape.

As the permeable supporting member, a plate-shaped or cylindrical supporting member can be exemplified. In addition, the mesh supporting 210 as described above and a supporting member 220 can be exemplified. Specifically, the mesh supporting member 210 and the supporting member 220 described above can be exemplified.

The permeable supporting member 200 can be removably placed on a nonwoven fabric manufacturing apparatus 90. This enables the permeable supporting member 200 in accordance with desired nonwoven fabric to be disposed as needed. In other words, the permeable supporting 200 can be exchanged for one permeable supporting member selected from a plurality of different permeable supporting members in the nonwoven fabric manufacturing apparatus 90.

The mesh portion of the mesh supporting member 210 shown in FIG. 4 or the supporting member 220 shown in FIG. 3 will be described below. As a permeable mesh portion, there are exemplified a permeable net woven in a plain, diagonal, satin, double, or spiral pattern using thread or yarn made of resin such as polyester, polyphenylene sulfide, nylon, and conductive monofilament, or wire made of metal such as stainless, copper, and aluminum.

The air permeability of the permeable net can be partly changed by partly changing a weaving method, the thickness of thread or yarn, or the shape of thread or yarn. Specifically, there are exemplified the permeable mesh in a polyester spiral weaving pattern and a permeable mesh in a stainless spiral weaving pattern with flat or round thread or yarn.

As a plate-shaped supporting member 230 shown in FIG. 10 and a plate-shaped supporting member 290 shown in FIG. 17, a sleeve made of stainless steel, copper, aluminum or the like can be exemplified. The sleeve can be exemplified with a plate partly hollowed in a predetermined pattern. The hollowed portion of the metal is a second permeable portion and the remaining portion is an impermeable portion. Preferably, the surface of the impermeable portion is smooth so as to improve slip of the surface as described above.

As the sleeve, there is exemplified a sleeve made of stainless steel having a thickness of 0.3 mm in which each of open portions is made by hollowing a plate with a rounded oblong rectangle having a length of 3 mm and a width of 40 mm to place in a lattice state having a space of 2 mm in the line flowing direction (traveling direction) and 3 mm in the width direction.

A sleeve formed with open portions arranged in a staggered manner can be exemplified. There is exemplified a sleeve made of stainless steel having a width of 0.3 mm in which each of open portions is formed by hollowing a plate with a circle having a diameter of 4 mm in a staggered manner at pitches of 12 mm in the line flowing direction (traveling direction) and at pitches of 6 mm in the width direction. The hollowing patterns (formed open portions) and arrangement can be optionally set.

The permeable supporting member 200 having predetermined undulations can be exemplified. There is exemplified a permeable supporting member in which a portion without being directly blown by the fluid, mainly composed of gas, has alternative wavelike undulations in the line flowing direction (traveling direction). For example, predetermined openings are formed using the permeable supporting 200 in the above shape, thus totally obtaining the nonwoven fabric formed in such a shape as to have alternative wavelike undulations on the permeable supporting member 200.

5.2.3. Blowing Means

Changing the direction of fluid mainly composed of gas blown by a blowing section 910 enables, for example, to adjust an interval between recessed portions (groove portions) in formed undulations, and a height of a concave portion as necessary. Moreover, a structure for automatically changing the direction of fluid, for example, enables to make adjustment so as to form a groove portion into a snaking, wavelike, zigzagging or other shape. Furthermore, adjustment of blowing amount or blowing time of fluid mainly composed of gas enables to adjust the shape of groove portions or open portions or a forming pattern as necessary. A blowing angle of fluid mainly constituted of gas to the fiber web 100 may be perpendicular. In addition, either of an angle deviated from a line flowing direction as a traveling direction F of the fiber web 100 by a predetermined angle or an angle deviated by a predetermined angle opposite to the line flowing direction is also available.

5.2.4. Heating Means

As methods for bonding fiber 101 in nonwoven fabric 120 formed with predetermined open portions, the following examples are available: the needle punch method, span lace method, solvent adhesion method, point bond method, and thermal fusion by air through method. Above of all, the air through method is preferable to maintain the shape of a formed predetermined open portion. For example, heat treatment by the air through method with a heater section 950 is preferable.

5.2.5. Others

A nonwoven fabric 115 heated and manufactured with the heater section 950 is conveyed to a process of cutting the nonwoven fabric 115 into a predetermined shape and a process of winding the nonwoven fabric by a conveyer 930 and a conveyer 940 continuous thereto in a predetermined direction F. The conveyer 940 may be provided with a belt section 949 and a rotating section 941 like the conveyer 930.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A nonwoven fabric having a first direction and a second direction transverse to the first direction, and first and second opposite surfaces, said non-woven fabric comprising on the first surface thereof:

a plurality of groove portions longitudinally extending in the first direction; and a plurality of convex portions longitudinally extending in the first direction, said groove portions and convex portions being alternately arranged adjacent to each other in the second direction;

wherein each of said groove portions comprises:

a plurality of openings arranged along the first direction and extending though an entire thickness of the nonwoven fabric from the first surface to the second surface; and a plurality of joining portions each being formed between one pair of adjacent said openings in said groove portion;

each of the joining portions has a greater percent content of fibers oriented in the second direction than fibers oriented in the first direction;

each of the convex portions has side portions opposite one another in the second direction, and a central portion between said side portions; and the central portion of each of the convex portions includes more fibers oriented in a thickness direction of the nonwoven fabric than each of the groove portions;

wherein each of the joining portions comprises:

a first portion recessed in the thickness direction of the nonwoven fabric from the first surface toward the second surface; and a second portion which is not recessed and is adjacent to the first portion in the first direction.

2. The nonwoven fabric according to claim 1, wherein fibers in a peripheral edge of each of the openings are oriented along the peripheral edge of said opening.

3. The nonwoven fabric according to claim 1, wherein each of the openings is substantially circular or substantially oval.

4. The nonwoven fabric according to claim 1, wherein each of the openings is 0.1 to 5 mm in length in the first direction.

5. The nonwoven fabric according to claim 1, wherein a thickness of the non-woven fabric in each of the groove portions is not greater than 90% of a thickness of the nonwoven fabric in each of the convex portions.

6. The nonwoven fabric according to claim 1, wherein each of the groove portions is sandwiched in the second direction between convex portions having different heights.

7. The nonwoven fabric according to claim 1, wherein a top of each of the convex portions is substantially flat.

8. The nonwoven fabric according to claim 1, wherein the non-woven fabric further has on the second surface a plurality of concave areas located corresponding to the convex portions.

9. The nonwoven fabric according to claim 1, further undulating in the first direction.

10. The nonwoven fabric according to claim 1, wherein the second surface of the nonwoven fabric is substantially flat.

11. The nonwoven fabric according to claim 1, wherein, in each of the side portions in each of the convex portions, a percent content of fibers oriented in the first direction is greater than that oriented in the second direction.

12. The nonwoven fabric according to claim 1, wherein, in each of the convex portions, a percent open area measured from the first surface is greater than that measured from the second surface.

13. The nonwoven fabric according to claim 1, wherein a fiber density of each of the central portions is greater than that of each of the joining portions and is lower than that of each of the side portions.

14. The nonwoven fabric according to claim 13, wherein a fiber density of each of the convex portions is no greater than 0.20 g/cm$^3$, while the fiber density of each of the joining portions is no greater than 0.20 g/cm$^3$.

15. The nonwoven fabric according to claim 1, wherein a basis weight of each of the joining portions is less than that of each of the convex portions.

16. The nonwoven fabric according to claim 15, wherein each of the convex portions has the basis weight from 15 to 250 g/m$^2$, while each of the joining portions has the basis weight from 5 to 200 g/m$^2$.

17. The nonwoven fabric according to claim 1, wherein fibers constituting the nonwoven fabric includes water-repellent fibers.

18. The nonwoven fabric according to claim 1, wherein, in each of the convex portions, the side portions has a percent content of fibers, which are oriented in the first direction, greater than that of the central portion.

19. The nonwoven fabric according to claim 18, wherein the percent content of fibers oriented in the first direction in the central portions is at least 10% lower than that in the side portions and at least 10% higher than that in the groove portions.

20. The nonwoven fabric according to claim 1, wherein each of the first portions defines a concave U shape, as seen from the first surface, and, together with the adjacent second portion, connects the adjacent openings in the respective groove portion.

21. The nonwoven fabric according to claim 1, wherein each of the joining portions comprises one said first portion and two said second portions at opposite ends, as seen in the first direction, of said first portion, each of the second portions connecting the first portion with one of the adjacent openings between which said joining portion is formed.

22. A nonwoven fabric having a first direction and a second direction transverse to the first direction, and opposite upper and lower sides, said non-woven fabric comprising on the upper side thereof:

a plurality of groove portions longitudinally extending in the first direction; and a plurality of convex portions longitudinally extending in the first direction, said groove portions and convex portions being alternately arranged adjacent to each other in the second direction;

wherein each of said groove portions comprises:

a plurality of first and second portions alternately arranged adjacent to each other in the first direction;

each said first portion being recessed in a thickness direction of the nonwoven fabric from the upper side toward the lower side;

each said second portion having an opening extending through an entire thickness of the non-woven fabric from an upper surface of said second portion to a lower surface thereof; and an upper surface of a bottom of each said first, recessed portion being at a lower level than the upper surface of the adjacent second portions;

each of the first portions has a greater percent content of fibers oriented in the second direction than fibers oriented in the first direction;

each of the convex portions has side portions opposite one another in the second direction, and a central portion between said side portions; and the central portion of each of the convex portions includes more fibers oriented in a thickness direction of the nonwoven fabric than each of the groove portions.

23. The nonwoven fabric according to claim 22, wherein the upper surface of the bottom of each said first, recessed portion is lower than the lower surface of the adjacent second portions.

* * * * *